US007290763B2

(12) United States Patent
Suzuki et al.

(10) Patent No.: US 7,290,763 B2
(45) Date of Patent: Nov. 6, 2007

(54) SHEET FEEDING APPARATUS AND IMAGE READING AND RECORDING APPARATUS PROVIDED WITH THE SAME

(75) Inventors: Yoshiaki Suzuki, Chiba (JP); Akio Okubo, Tokyo (JP); Takashi Awai, Tokyo (JP); Hideyuki Terashima, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 10/739,348

(22) Filed: Dec. 19, 2003

(65) Prior Publication Data

US 2004/0130089 A1 Jul. 8, 2004

(30) Foreign Application Priority Data

Dec. 24, 2002 (JP) ..... 2002-371629

(51) Int. Cl.
*B65H 3/44* (2006.01)

(52) U.S. Cl. ..... 271/9.13; 271/9.01; 271/9.05

(58) Field of Classification Search ..... 271/9.03, 271/9.12, 9.01, 9.13; 318/432, 434, 685, 318/696; 358/496, 497, 296
See application file for complete search history.

(56) References Cited

U.S. PATENT DOCUMENTS 5,124,800 A * 6/1992 Hashimoto ..... 358/296
5,153,655 A 10/1992 Suzuki et al. ..... 355/285
5,157,444 A 10/1992 Mori et al. ..... 355/282
5,391,009 A 2/1995 Stodder ..... 400/605
5,745,661 A 4/1998 Koh et al. ..... 395/113
5,838,132 A * 11/1998 Tanaka ..... 318/685
5,954,326 A * 9/1999 Gaarder et al. ..... 271/9.02
6,022,013 A * 2/2000 Foglino et al. ..... 271/9.08
6,102,506 A 8/2000 Sasai et al. ..... 347/3
6,385,406 B1 5/2002 Funamizu et al. ..... 399/16

FOREIGN PATENT DOCUMENTS

JP 03177241 A * 8/1991

* cited by examiner

*Primary Examiner*—Patrick Mackey
*Assistant Examiner*—Kaitlin S Joerger
(74) *Attorney, Agent, or Firm*—Fitzpatrick, Cella, Harper & Scinto

(57) ABSTRACT

A first sheet feeding device and a second sheet feeding device for feeding sheets stacked on a first stacking portion and a second stacking portion, respectively, are driven by a driving force generated by a drive source. A controller controls the drive source so that the magnitude of the driving force may differ between a case where the first sheet feeding device is driven and a case where the second sheet feeding device is driven.

10 Claims, 19 Drawing Sheets

SHEET FEEDING APPARATUS AND IMAGE READING AND RECORDING APPARATUS PROVIDED WITH THE SAME

BACKGROUND OF THE INVENTION

1. Field of the Invention

The invention relates to a sheet feeding apparatus and an image reading and recording apparatus provided with the same, and particularly to a sheet feeding apparatus provided with first sheet stacking means and second sheet stacking means for stacking sheets thereon.

2. Related Background Art

There has heretofore been a sheet feeding apparatus for feeding a sheet provided with first stacking means and second stacking means for stacking sheets such as recording paper and originals thereon, and as such a sheet feeding apparatus, there is one provided, for example, in a printer enabling manual sheet feeding to be effected, and adapted to feed sheets stacked on the first stacking means and sheets manually stacked on the second stacking means to an image recording portion by an automatic sheet feeding mechanism and a manual sheet feeding mechanism, respectively.

Also, as another example, there is one provided in an image reading and recording apparatus integrally provided with an image reading portion for reading the image of an original and an image recording portion for recording (forming) an image on recording paper.

FIG. 19 of the accompanying drawings schematically shows the construction of a facsimile apparatus adapted to record an image on a sheet by an ink jet recording process, which is an example of an image reading and recording apparatus provided with such a conventional sheet feeding apparatus, and in this facsimile apparatus, when an image is to be recorded on recording paper 301 which is a sheet, sheets of recording paper 301 placed on a first recording paper holding member 303 which is first stacking means are first separated and fed out one by one by a recording paper feeding roller 304 which is first sheet feeding means connected to a recording paper transporting motor (not shown) and a separating mechanism (not shown), thereafter the recording paper 301 is transported to an image recording portion 306 by feeding rollers 305.

Next, in this image recording portion 306, ink is discharged while an ink cartridge which is image recording means, not shown, is moved in a scanning direction, whereby an image is recorded on the recording paper. After the image has been thus recorded, the recording paper 301 is delivered out of the apparatus by delivery rollers 307 as indicated by the arrow B0.

On the other hand, when the image of a document 302 is to be read, documents 302 are first set a document holding member 308 which is second stacking means in a form rammed in a wedge shape formed by a document separating roller 309 and a separating piece 313 driven by a document separating and transporting motor (not shown), next, in this state, among the documents 302 stopped by the wedge shape, only the document which is in contact with the document separating roller 309 is separated and transported by friction from the original separating roller 309 which is second sheet feeding means rotated on the basis of an image reading command.

Next, the thus separated and transported document 302 is passed above a contact image sensor 311 which is reading means provided in an image reading portion while being nipped between document feeding rollers 310 and between a delivery roller 312 and a runner 312*a* opposed thereto, whereby image information is read. After the image information has been thus read by the contact image sensor 311, the document 302 is delivered out of the apparatus as indicated by the arrow A0.

In the facsimile apparatus of such a construction, in order to realize the downsizing and lower cost of the apparatus, a transport path for use in common as an original transporting path and a recording paper transporting path is shown in Japanese Patent Application Laid-Open No. H07-183990.

However, in the conventional sheet feeding apparatus and a facsimile apparatus (image reading and recording apparatus) provided with the same, when design is made such that document transport and recording paper transport are effected by one and the same drive source, if there is a difference between torque necessary to effect the document transport and torque necessary to effect the recording paper transport, there arises the problem that the noise and step-out by overtorque occur.

SUMMARY OF THE INVENTION

So, the present invention has been made in view of such circumstances, and an object thereof is to provide a sheet feeding apparatus in which noise and step-out can be prevented from occurring even when a single drive source is used, and an image reading and recording apparatus provided with the same.

Another object of the present invention is to provide a sheet feeding apparatus provided with first stacking means and second stacking means, first sheet feeding means and second sheet feeding means for feeding sheets stacked on the first stacking means and the second stacking means, respectively, a single drive source for generating a driving force for driving the first sheet feeding means and the second sheet feeding means, and controlling means for controlling the single drive source, wherein the controlling means controls the single drive source so that the magnitude of the driving force may differ between a case where the first sheet feeding means is driven and a case where the second sheet feeding means is driven.

Another object of the present invention is to provide an image reading and recording apparatus provided with first stacking means for stacking sheets thereon, first sheet feeding means for feeding the sheets stacked on the first stacking means, an image recording portion for recording images on the sheets fed by the first sheet feeding means, second stacking means for stacking documents thereon, second sheet feeding means for feeding the documents stacked on the second stacking means, an image reading portion for reading the images of the documents fed by the second sheet feeding means, a single drive source for generating a driving force for driving the first sheet feeding means and the second sheet feeding means, and controlling means for controlling the single drive source, wherein the controlling means controls the single drive source so that the magnitude of the driving force may differ between a case where the first sheet feeding means is driven and a case where the second sheet feeding means is driven.

DETAILED DESCRIPTION OF THE PREFERRED EMBODIMENTS

An embodiment of the present invention will hereinafter be described in detail with reference to the drawings.

However, the dimensions, materials and shapes of constituent parts and the relative arrangement thereof or the like described in this embodiment is not intended to restrict the scope of the present invention thereto unless particularly specified.

Figure 1:
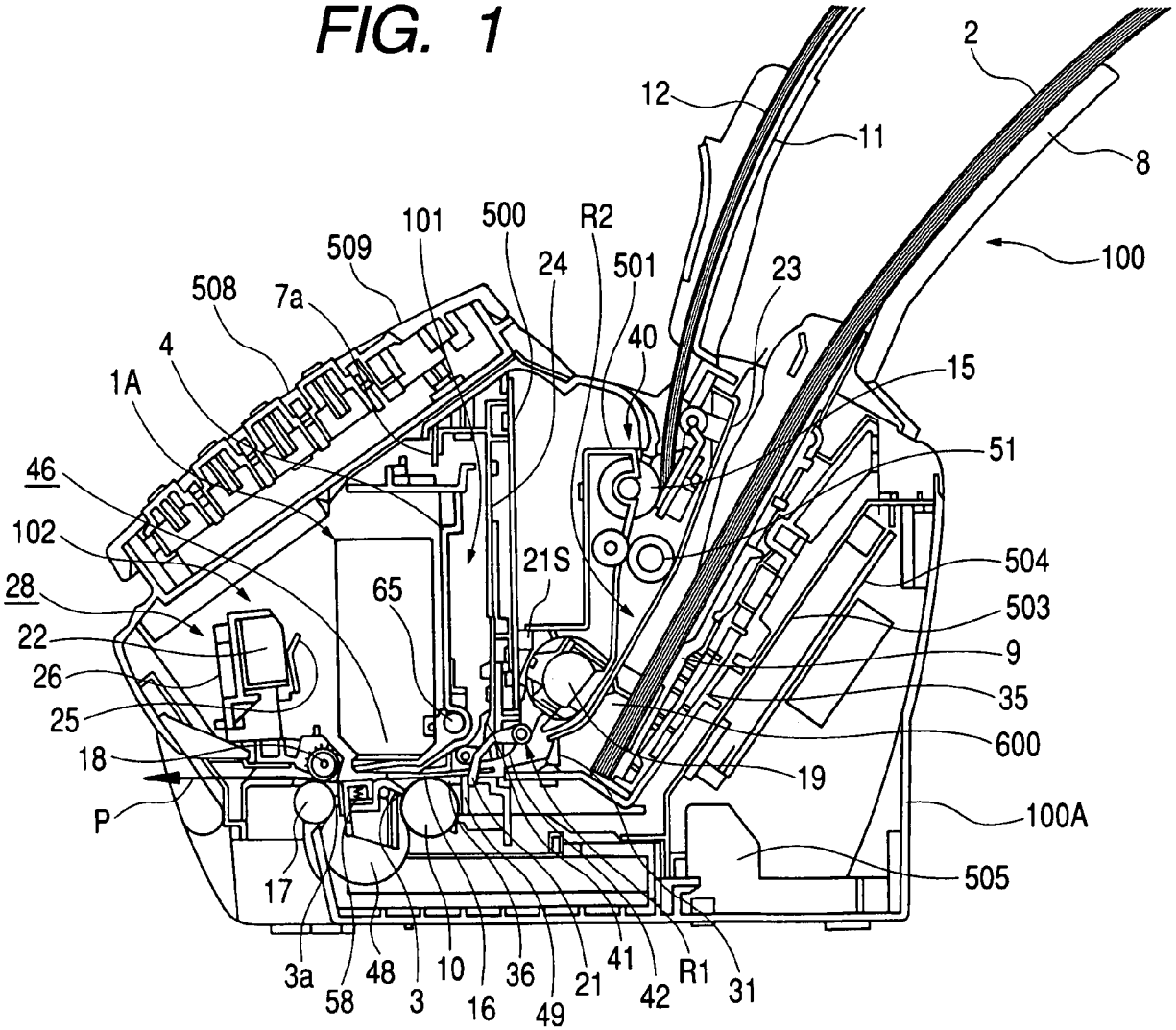
FIG. 1 is a cross-sectional view showing the construction of a facsimile apparatus which is an example of an image reading and recording apparatus provided with a sheet feeding apparatus according to an embodiment of the present invention.

FIG. 1 is a cross-sectional view showing the construction of a facsimile apparatus which is an example of an image reading and recording apparatus provided with a sheet feeding apparatus according to the embodiment of the present invention.

In FIG. 1, the reference numeral 100 designates a facsimile apparatus which is provided with an image recording apparatus portion 101 provided with an image recording portion 1A for recording an image on recording paper 2 which is a sheet, an image reading apparatus portion 102 provided with an image reading portion 28 for reading the image of a document 12, a recording paper transport path R1 which is a first transport path along which the recording paper 2 passes, a document transport path R2 which is a second transport path along which the document 12 passes, and a common transport path 49 provided downstream of the recording paper transport path R1 and the document transport path R2 with respect to a transport direction.

On the common transport path 49, there are provided a transport roller 10 which is common feeding means for transporting the document 12 and the recording paper 2, and a delivery roller 17 which is common delivery means.

The construction of the image recording apparatus portion 101 will now be described.

Figure 2:
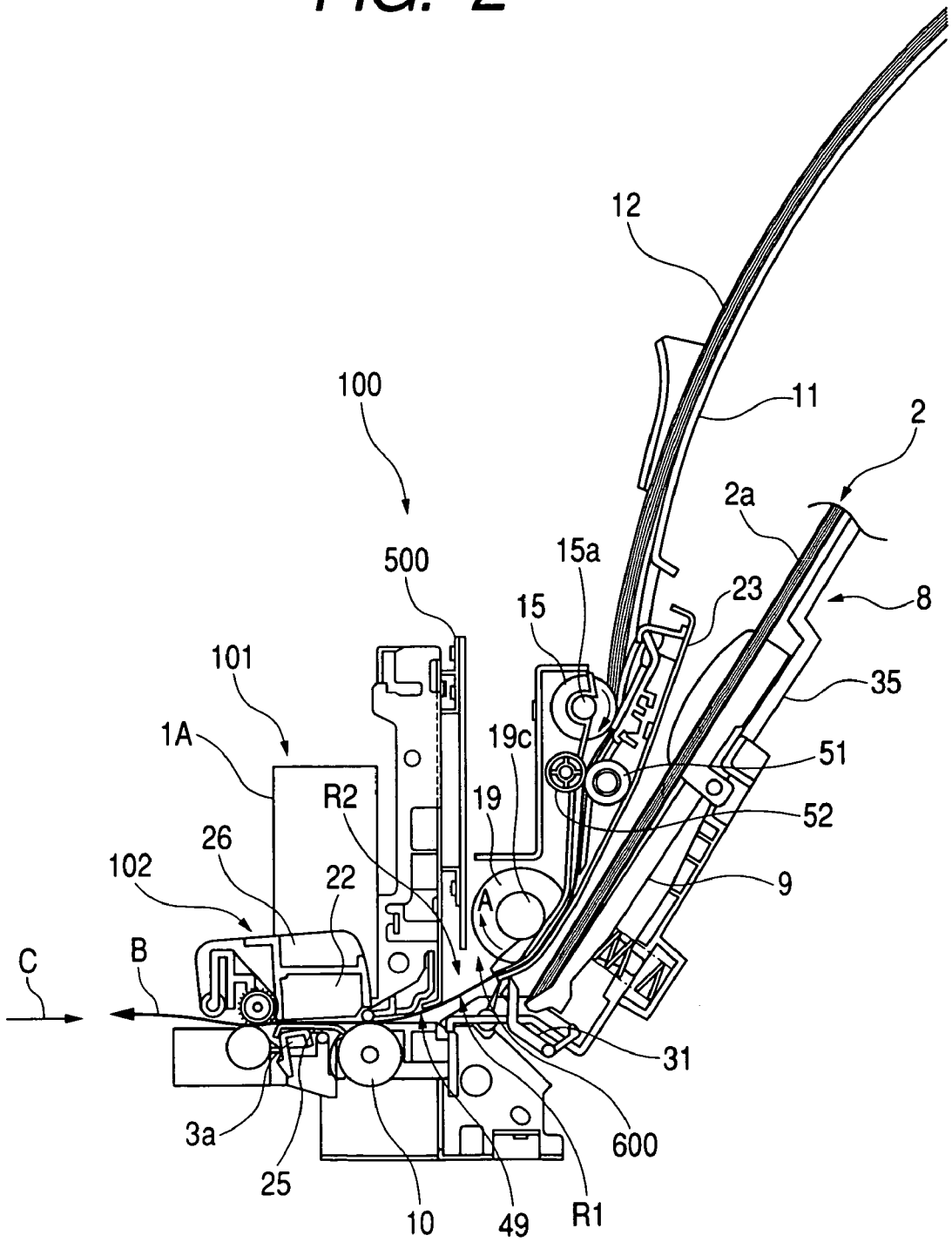
FIG. 2 is a cross-sectional view illustrating the construction of the recording paper and document feeding system of the sheet feeding apparatus.

The image recording apparatus portion 101 is provided with the image recording portion 1A which will be described later, and in addition, a recording paper supply tray 8 which is first stacking means capable of plural sheets of recording paper 2 stacking and containing thereon, and a recording paper feeding portion 600 having a recording paper separating roller 19 rotated in the direction indicated by the arrow A as shown in FIG. 2, a pressure plate 9 located between the recording paper separating roller 19 and a base member 35 and pivotally supported on the base member 35, a separating pawl 31, etc.

The pressure plate 9 is designed to be pivotally moved in a vertical direction with the rotation of the recording paper separating roller 19, by a cam (not shown) formed integrally with the recording paper separating roller 19, to thereby bring the recording paper 2 into contact with, or space the recording paper 2 apart from the outer peripheral surface of the recording paper separating roller 19.

Also, the separating pawl 31 serves to intercept the sheets of recording paper 2 stacked on the recording paper supply tray 8. When the recording paper separating roller 19 is rotated, the uppermost recording paper 2*a* being in contact with the recording paper separating roller 19 is adapted to be transported over the separating pawl 31 by the friction thereof with the recording paper separating roller 19.

Figure 3:
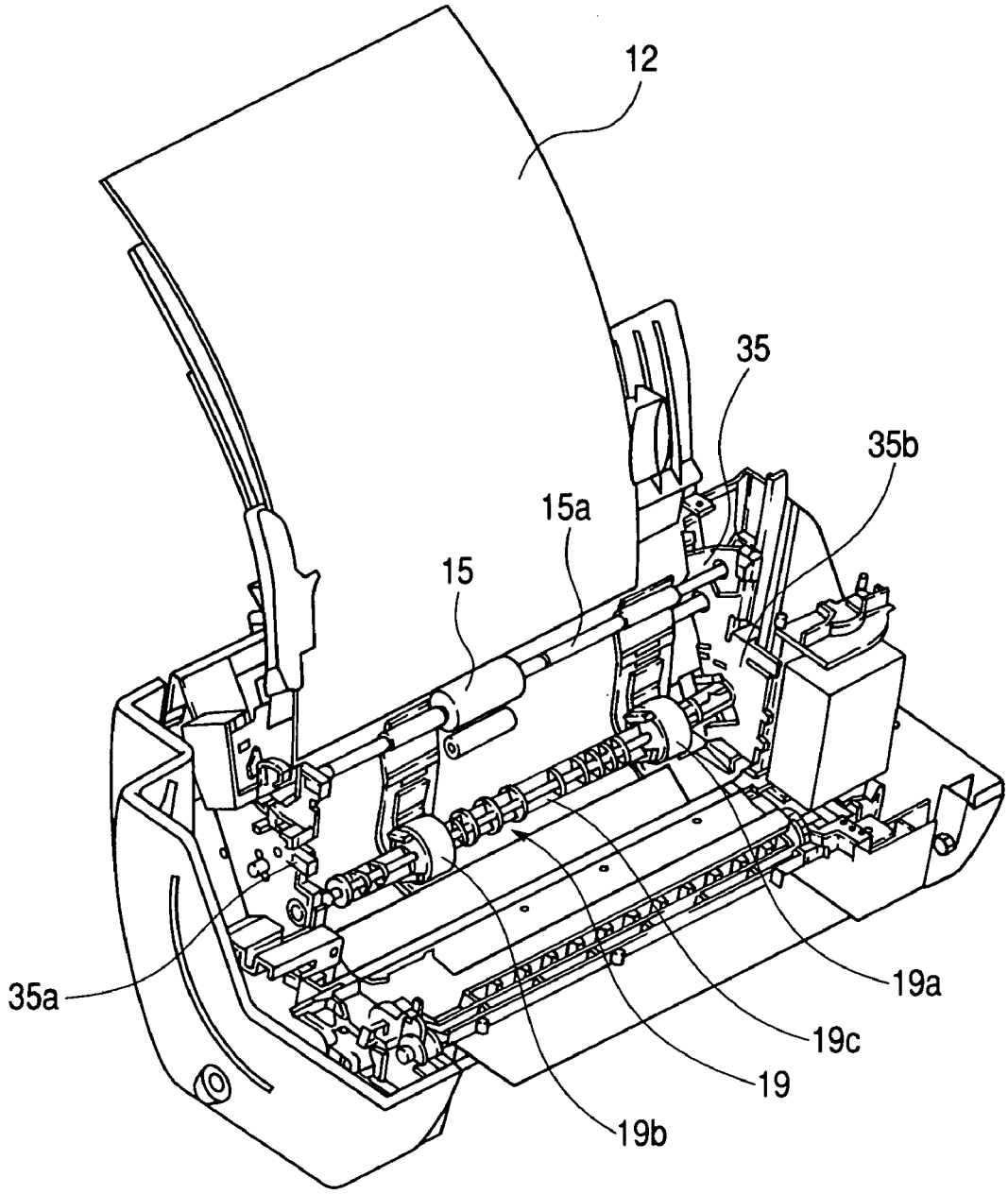
FIG. 3 is a perspective view showing the document transporting state of the facsimile apparatus.
Figure 4:
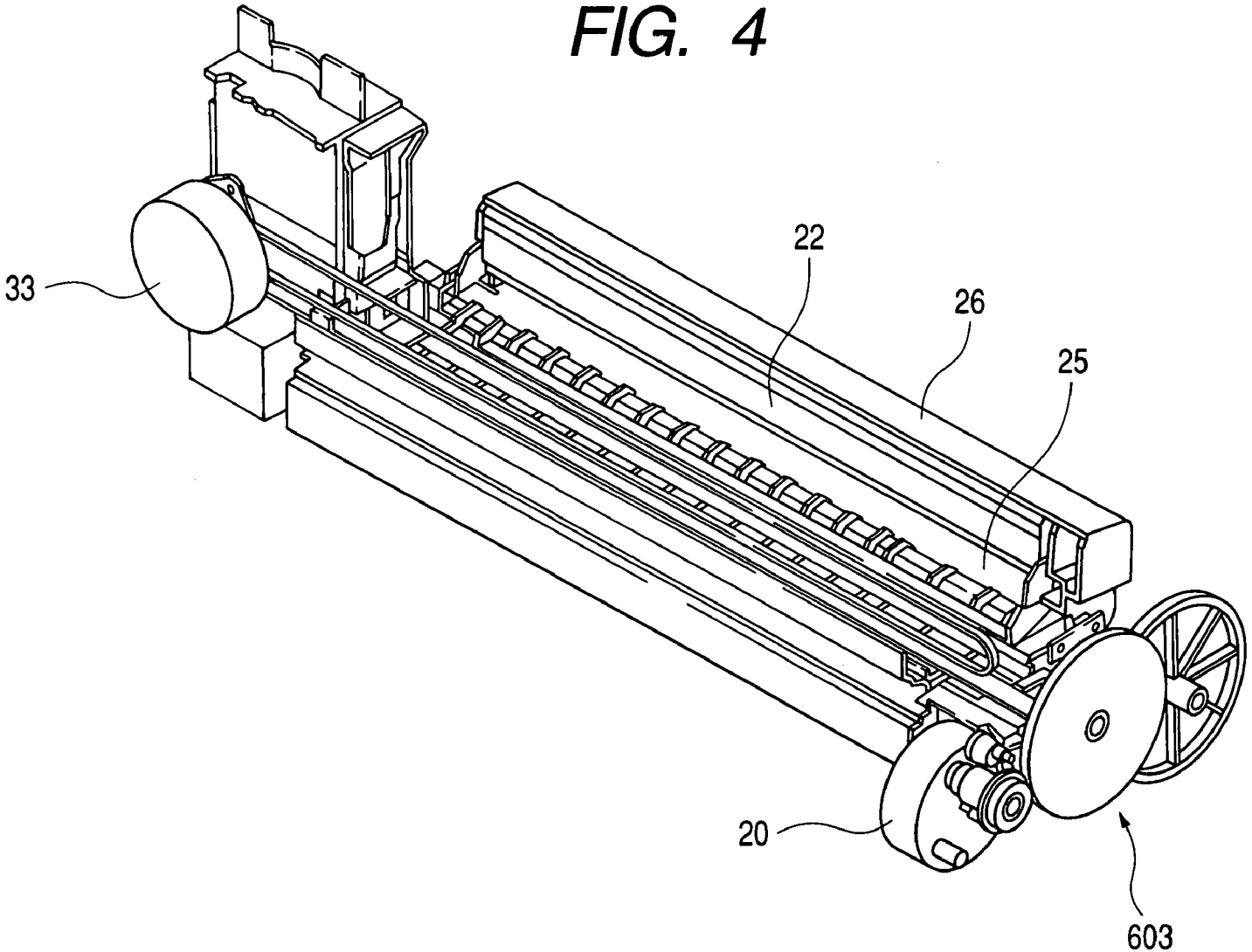
FIG. 4 is a perspective view showing a white reference member for the disposition and spaced-apart state of a motor in the facsimile apparatus.

The recording paper separating roller 19 which is first sheet feeding means is constituted by attaching a frictional elastic material, e.g. rubber, to two cylindrical portions formed on a shaft member formed of plastics so as to have a diameter larger than that of the shaft, and as shown in FIG. 3, the opposite end portions of the shaft member 19*c* are journalled to the opposite side portions 35*a* and 35*b* of the base member 35, and one end thereof is connected to a drive motor 20 which is a single drive source shown in FIG. 4 via recording drive transmitting means 603 shown in FIG. 4.

Figure 5:
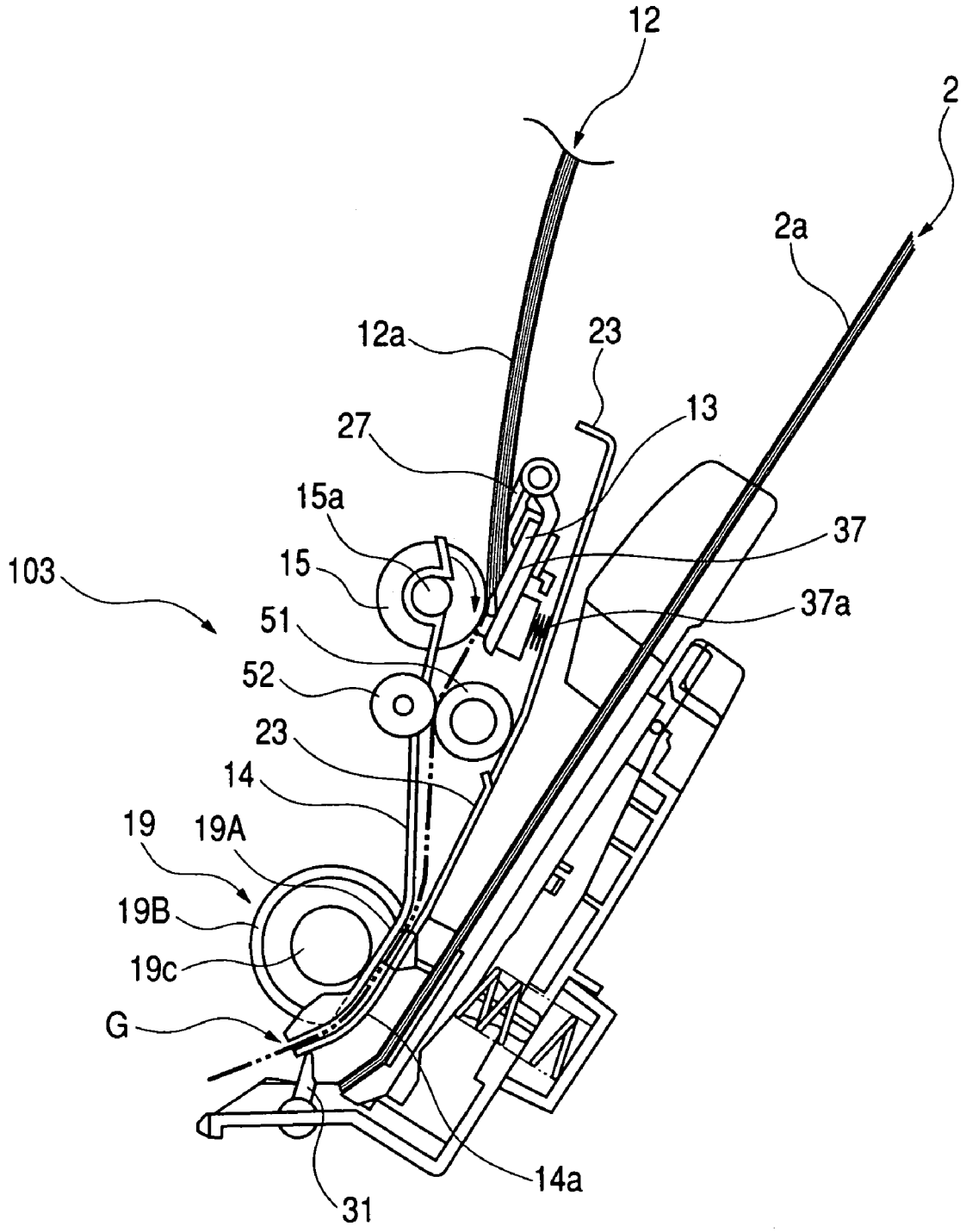
FIG. 5 is a cross-sectional view showing the document transporting state of the sheet feeding apparatus.
Figure 6:
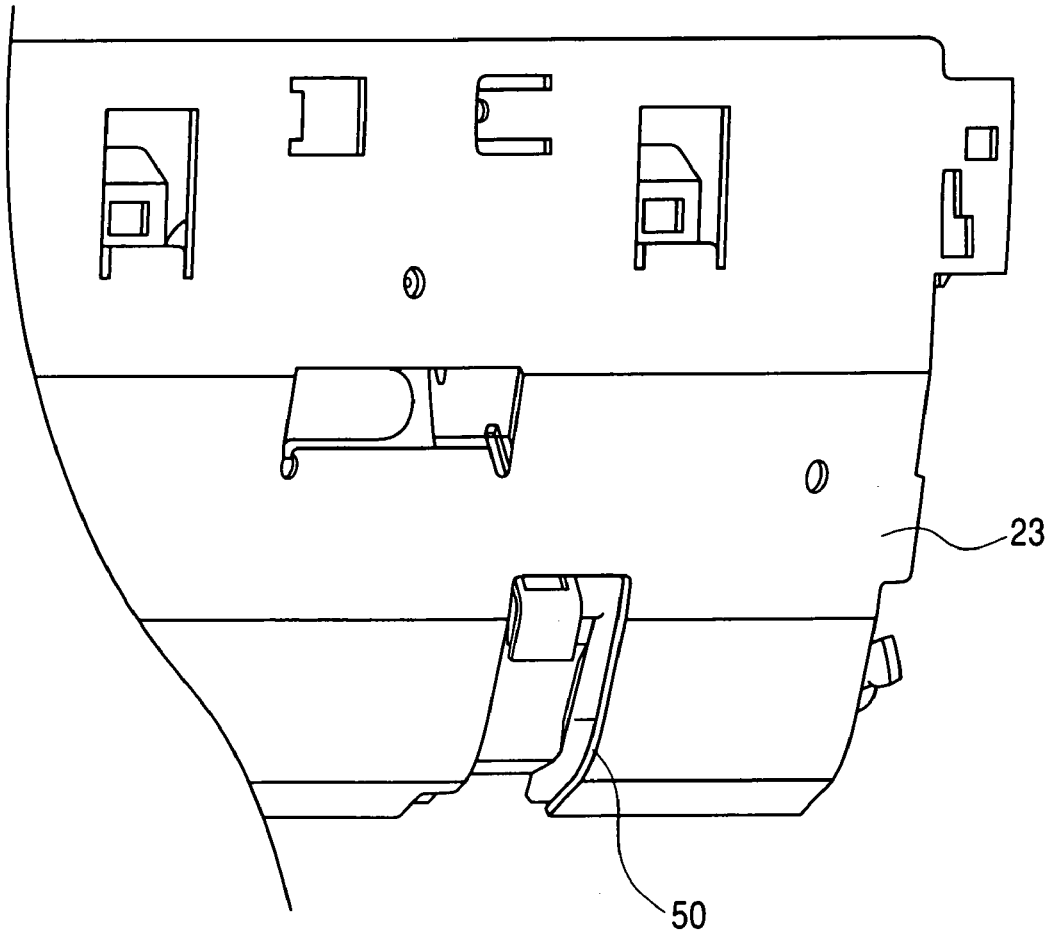
FIG. 6 is a perspective view showing the positional relation between the document lower guide member and the recording paper separating roller of the sheet feeding apparatus.

Also, the recording paper separating roller 19 is adapted to be stopped when in a standby state so that as shown in FIG. 5, the D-shaped cut-away portion 19A thereof may be opposed to the recording paper, and to form a gap G for passing the document 12 therethrough between itself and a document lower guide member 23 for guiding the document 12 to the common transport path 49 as will be described later. When the recording paper 2 is to be transported, the recording paper separating roller 19 is adapted to be rotated so that the circumferential portion 19B thereof may clear a cut-away 50 formed in the document lower guide member 23 which is shown in FIG. 6 and protrude downwardly of the document lower guide member 23, and contact with the uppermost recording paper 2*a* (see FIG. 5) of the recording paper stack placed on the pressure plate 9.

Further, this recording paper separating roller 19 makes one full revolution, whereafter the cut-away portion 19A becomes again opposed to the recording paper 2 and is returned to the standby state shown in FIG. 5 wherein the pressure plate 9 has been depressed by a cam. Thus, when the transporting roller 10 is transporting the uppermost recording paper 2*a*, the second and subsequent recording paper 2 does not contact with the recording paper separating roller 19, and it becomes possible to effect the stable transport of the recording paper 2.

Downstream of the recording paper separating roller 19, as shown in FIG. 1, there is provided a paper edge sensor (PES) lever 21 for detecting the transport of the recording paper 2 (or the document 12), and design is made such that if a PES 215 does not detect the passage of the recording paper 2 (or the document 12) through the PES lever 21 even when the paper feeding operation is started, a paper refeeding operation is performed, and if the PES 21 does not yet detect the passage of the recording paper 2 (or the document 12), the transporting operation is error-stopped and an error is displayed on a display portion 509.

On the other hand, the common transport path 49 provided downstream of the recording paper transport path R1 along which the recording paper 2 fed out by the recording paper separating roller 19 passes with respect to the transport direction is provided with a platen 3 functioning as a supporting surface for transporting the recording paper 2, and an auxiliary platen member 3*a* provided downstream of the platen 3 and functioning as a supporting surface for the underside of the recording paper 2 subsequently to the platen 3.

A plurality of ribs 38 (see FIG. 8) are formed on the recording paper supporting surface of the platen 3 in the widthwise direction of the recording paper so that during the transport of the recording paper, the recording paper 2 may pass over the upper surfaces of these ribs 38.

Also, the auxiliary platen member 3*a* cooperating with the platen 3 which is a supporting member to constitute a supporting portion for supporting the recording paper 2 is held on the platen 3 for pivotal movement in a vertical direction through a shaft 3*a*1 disposed in a recess (not shown) formed in the recording paper supporting surface of the platen 3, and formed upstream of the opposite sides thereof with respect to the recording paper transport direction, and also is normally resiliently biased as by a spring 58, and is held in a position in which the upper recording paper supporting surface thereof becomes flush with a recording paper supporting surface constituted by the upper surface of the platen 3.

This auxiliary platen member 3*a*, when pushed from above it by a CS holder 26 or the like beyond the biasing force of the spring 58 as will be described later, is adapted to pivotally move in a direction to sink by the order of 5 mm relative to the recording paper supporting surface of the platen 3.

Figure 7:
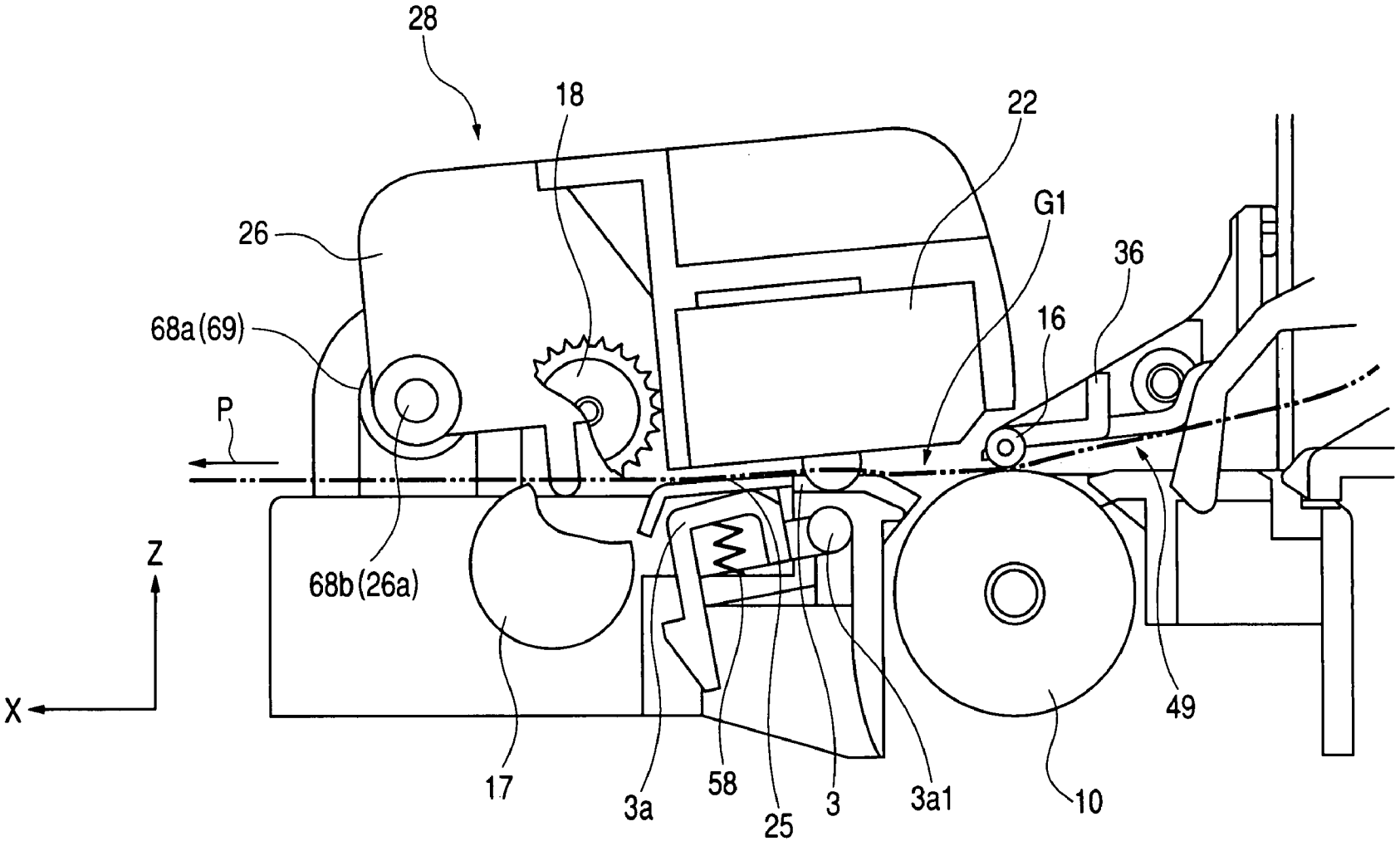
FIG. 7 shows the transport route of a document passing through a reading portion in the facsimile apparatus.
Figure 8:
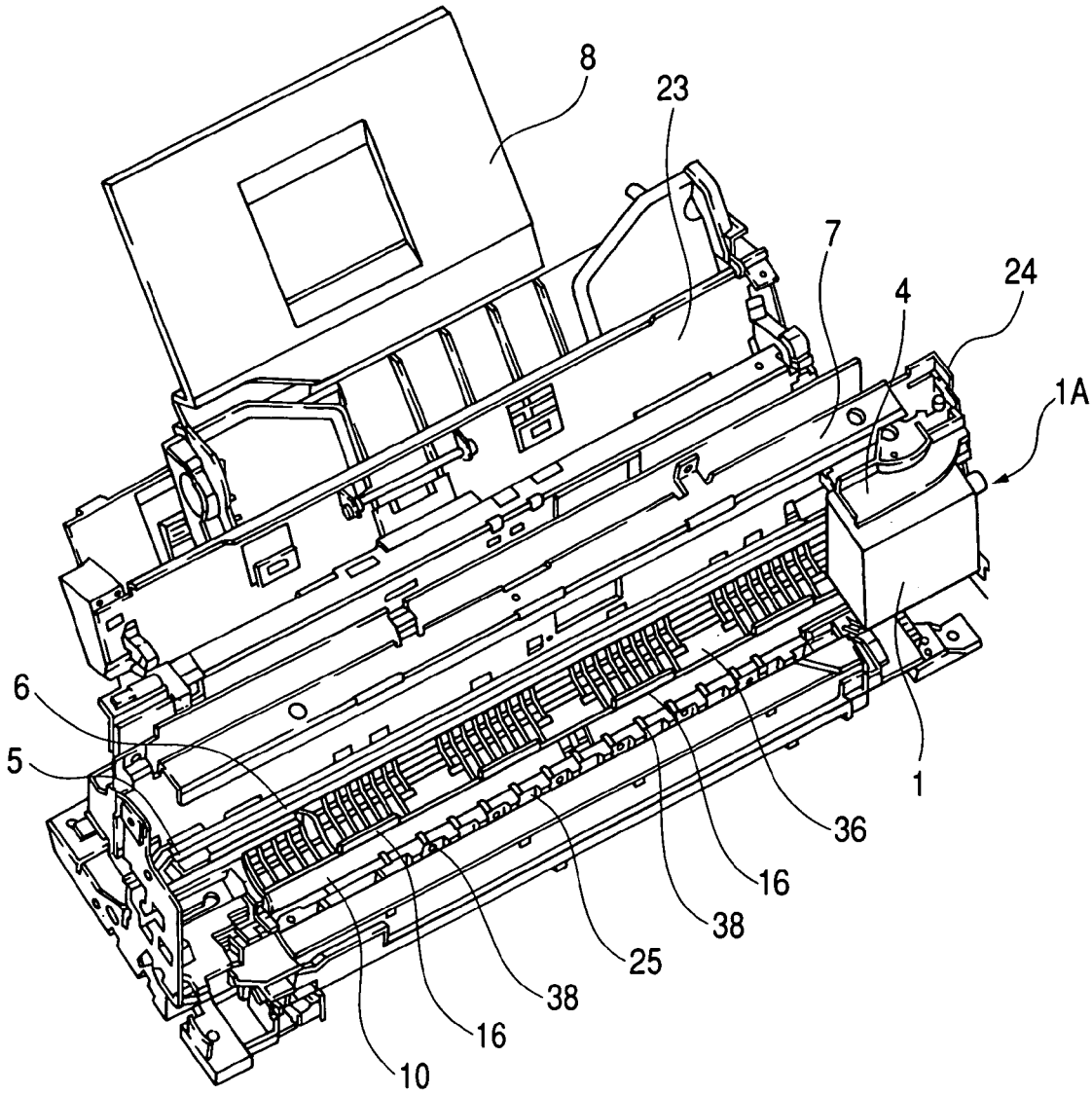
FIG. 8 is a perspective view showing the position of an image recording portion during the image reading operation of the facsimile apparatus.
Figure 9:
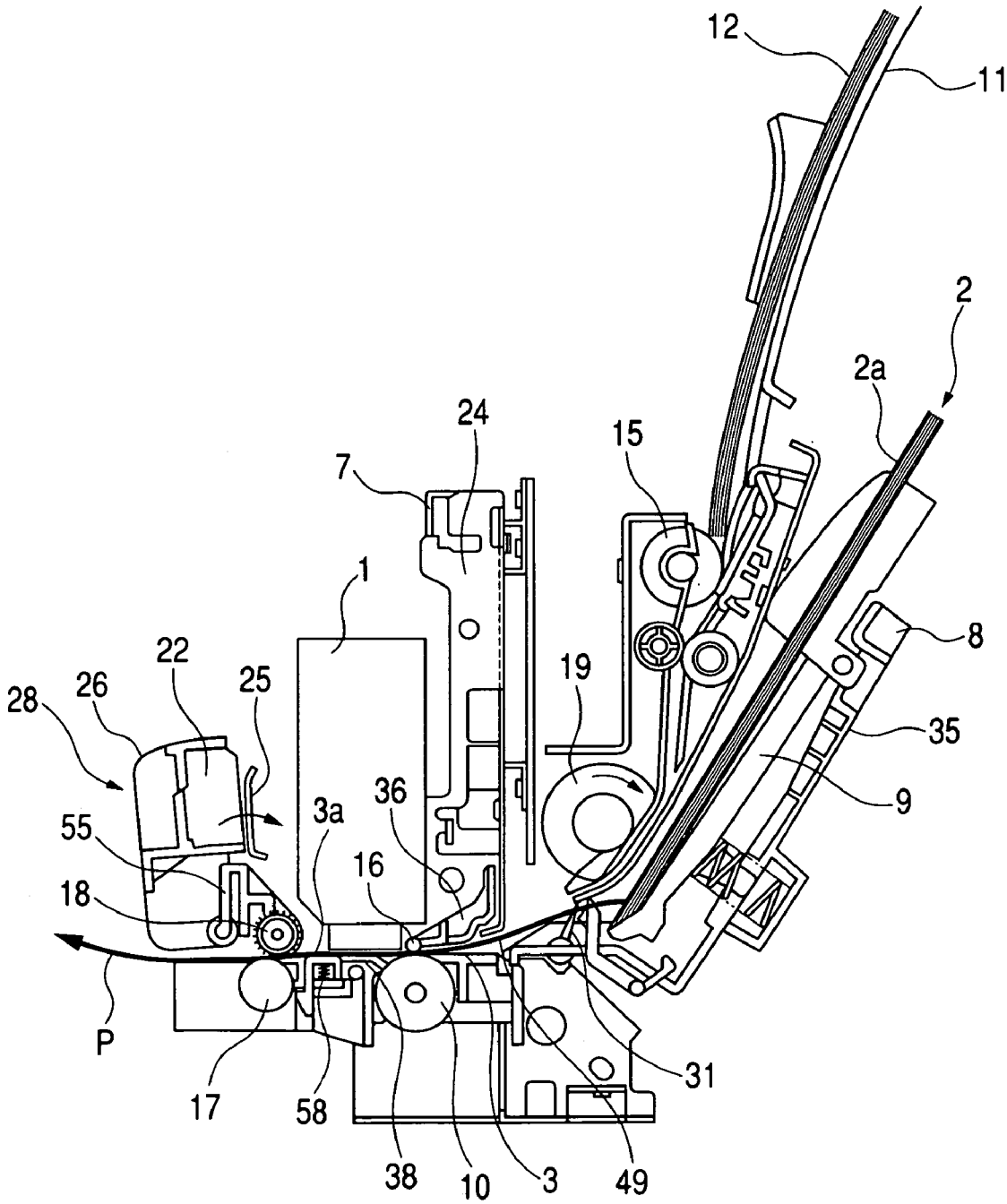
FIG. 9 is a cross-sectional view illustrating the general construction of the facsimile apparatus during the image recording operation thereof.

Further, the common transport path 49, as shown in FIGS. 7 and 8, is provided with the transporting roller 10 journalled to the platen 3, and the delivery roller 17 integrally molded with plastic and elastomer, and in addition, four pinch rollers 16 juxtaposed in the widthwise direction of the recording paper and being in contact with the transporting roller 10, a pinch roller guide 36 for journalling the pinch rollers 16 thereto so as to bring the pinch rollers 16 into pressure contact with the transporting roller 10, a plurality of spurs 18 being in contact with the delivery roller 17, and a spur holder 55 shown in FIG. 9 for journalling the spurs 18 thereto so as to bring the spurs into pressure contact with the delivery roller 17.

The transport direction of the recording paper 2 by the transporting roller 10 and the pinch rollers 16 is set so as to be obliquely downward from the upstream side to the downstream side of the rollers, and the transport direction of the recording paper 2 by the delivery roller 17 and the spurs 18 is set so as to be obliquely upward from the upstream side to the downstream side of the rollers. Thus, in the common transport path 49, the recording paper 2 is transported in the direction indicated by the arrow P while contacting with the upper surfaces of the platen 3 and the auxiliary platen member 3*a*.

A recording paper transporting force F generated by the transporting roller 10 and the pinch rollers 16 is of such a degree of magnitude that the frictional resistance force between the back of an original lower guide member 23 shown in FIG. 5 and the recording paper 2 can be neglected, but when recording paper feeding accuracy is affected thereby, a low-friction member such as a high molecular sheet may be stuck on the back of the original lower guide member 23.

Also, in FIGS. 8 and 9, the reference numeral 1 designates an ink cartridge which is image recording means, and the image recording portion 1A for recording an ink image on the recording material transported by the recording paper separating roller 19, the transporting roller 10 or the delivery roller 17 is of an ink jet recording type which discharges ink from this ink cartridge 1 to thereby effect recording. This ink cartridge 1 is provided with a minute liquid discharge port (orifice), a liquid path, an energy acting portion provided in a portion of the liquid path, and energy generating means for generating liquid droplet forming energy made to act on liquid present in the acting portion.

The reference numeral 4 denotes a carriage carrying the ink cartridge 1 thereon and scanning in the widthwise direction orthogonal to the transport direction of the recording paper 2, and this carriage 4 has connected thereto an endless timing belt 6 passed over a drive pulley, not shown, and a driven pulley 5, and the carriage 4 can be reciprocally moved along a guide rail 7 provided in the upper portion of a chassis 24 by the drive pulley being rotatively driven by a carriage driving motor 33 shown in FIG. 4. When the carriage 4 is thus reciprocally moved, the ink is discharged from the ink cartridge 1 in conformity with image information, whereby an image is recorded on the recording paper 2.

Now, this carriage 4 normally stands by in a standby position at one end (right end) of the guide rail 7 shown in FIG. 8, and when the carriage 4 is in such a standby position, the printing head, not shown, of the ink cartridge 1 is protected by a rubber member, not shown, so as not to dry. Also during an original image reading operation which will be described later, the carriage 4 stays in the standby position. Further., when the ink in the ink cartridge 1 has become exhausted, the ink cartridge 1 is removed toward this side in the position shown in FIG. 8 to thereby effect the interchange thereof.

In the ink jet recording process, there may occur a state in which the ink cartridge 1 becomes incapable of discharging the ink due to the mixing of bubbles or dust with the inward part of the minute discharge port, or increased viscosity or the like resulting from the evaporation of an ink solvent, or a state in which the ink becomes unsuitable for recording, but in such case, a head recovery operation for refreshing the ink is performed to thereby eliminate the factors for faulty discharge.

Figure 10:
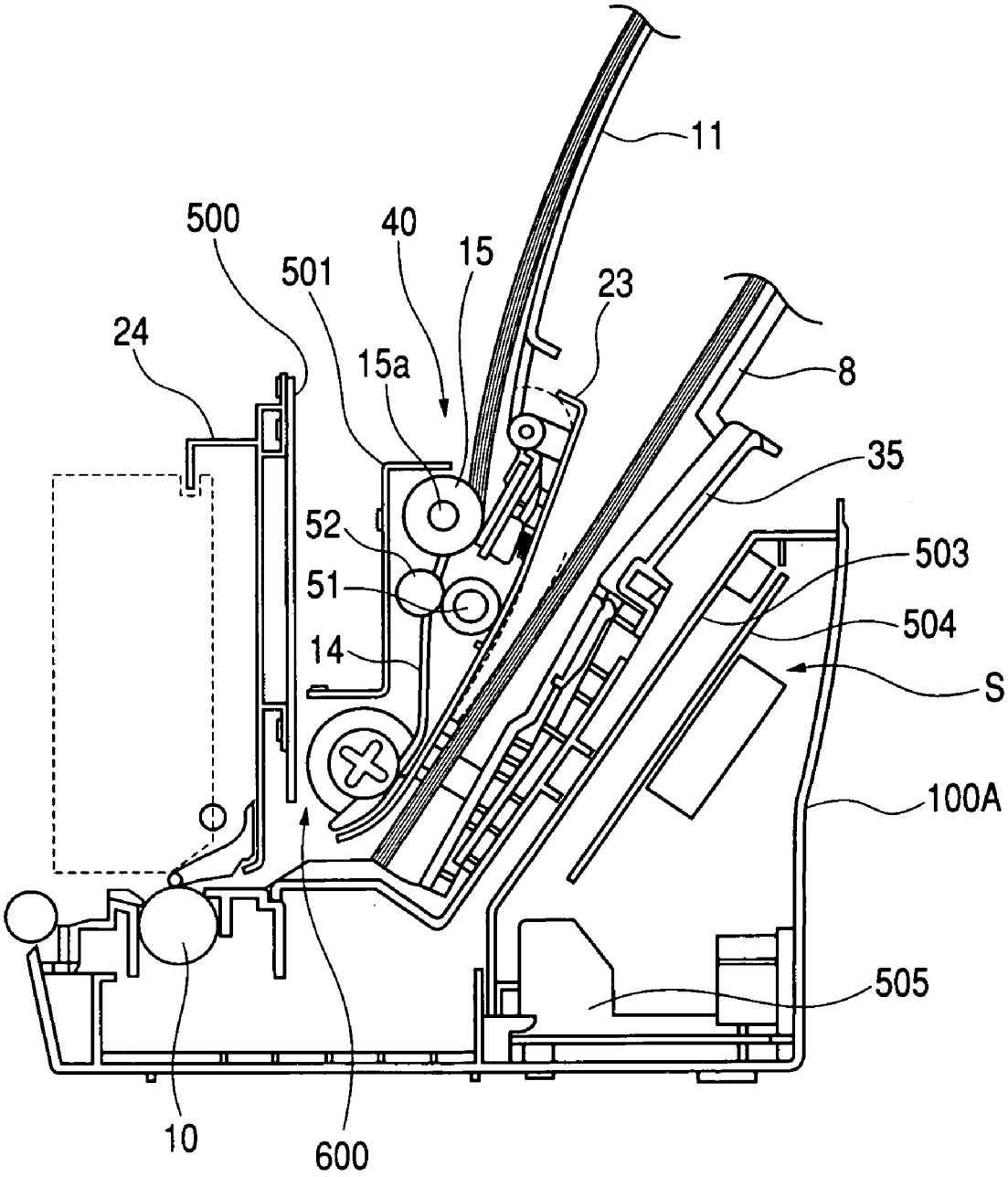
FIG. 10 illustrates the positional relations among a document transporting roller, a document separating roller and a transporting roller in the sheet feeding apparatus.

On the other hand, in FIGS. 1 and 10, the reference numeral 500 designates a control substrate attached to the back of the chassis 24 for effecting the control of an entire system, and this control substrate 500 is connected to a drive motor 20, a carriage driving motor 33, a speaker, not shown, an operating portion 508 and the image reading portion 28 by a cable, not shown. This control substrate 500 is disposed in a V-shaped space surrounded by an inclined base member 35 and the chassis 24 and therefore, the space in the facsimile apparatus 100 is effectively utilized and the downsizing of the entire apparatus becomes possible.

Figure 11:
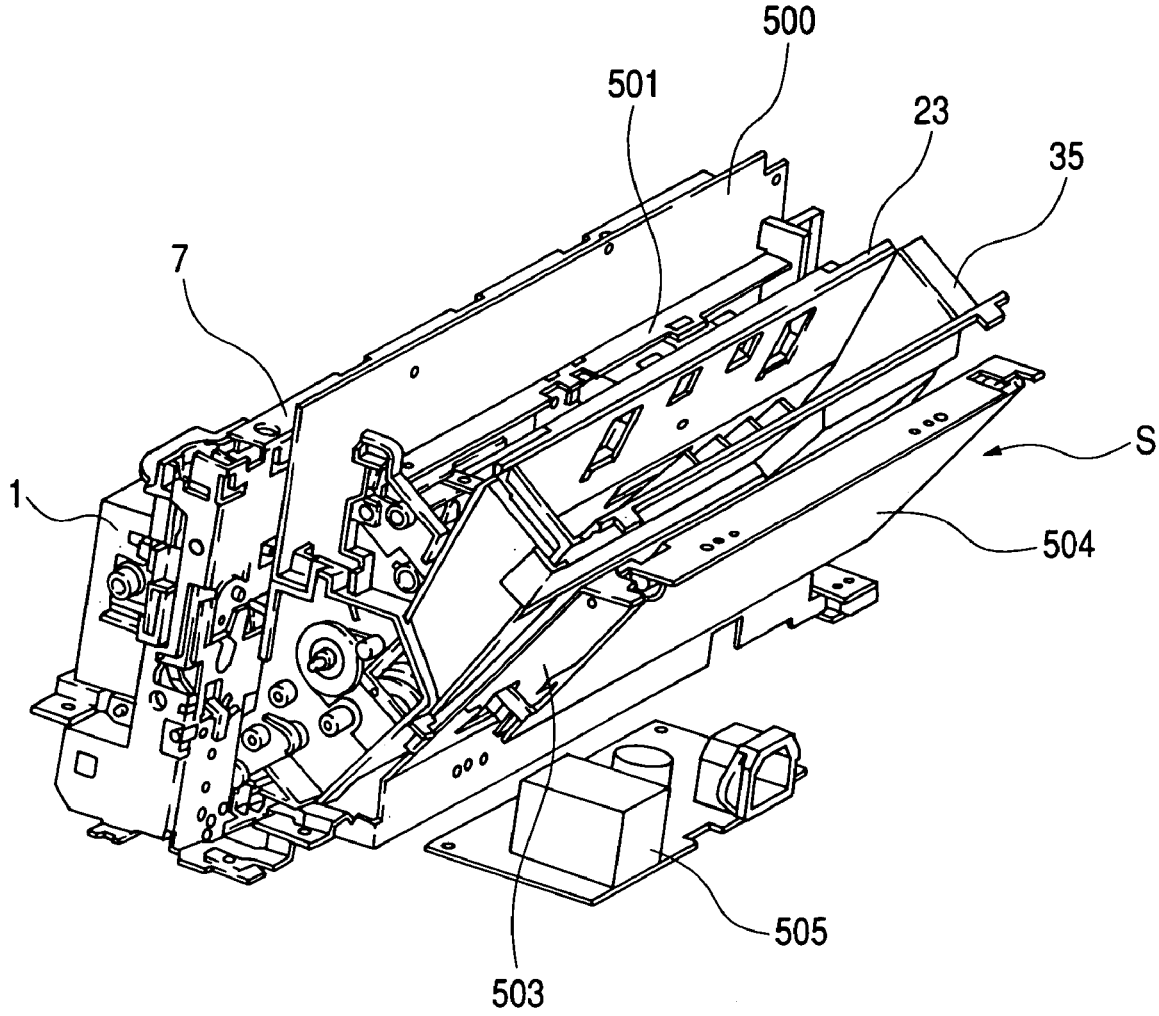
FIG. 11 is a perspective view showing the disposition of an electric power supply and the positional relation of a shield metal plate in the facsimile apparatus.

Further, this control substrate 500 is connected to an electric power supply 505 shown in FIGS. 10 and 11 for rectifying a primary voltage (AC commercial power supply), and an NCU substrate 504 to which a telephone line is connected and having a primary voltage portion before dropped in voltage, by a cable, not shown. The NCU substrate 504 and the electric power supply 505 are disposed in a space behind the inclined base member 35 and therefore, the space in the facsimile apparatus 100 is effectively utilized and the downsizing of the entire apparatus becomes possible.

The reference numeral 503 designates a shield metal plate covering the electric power supply 505 and the NCU substrate 504 disposed in the space S behind the base member 35, and a noise the control substrate 500 receives from the electric power supply 505 and the NCU substrate 504 can be mitigated by this shield metal plate 503. This shield metal plate 503 is fastened to a lower cover 100A by a screw or the like and therefor, even if the apparatus should fall and a gap is formed above the lower cover 10A, it will never happen that a user touches the NCU substrate 504 and the electric power supply 505.

Now, in the present embodiment, this control substrate 500, as shown in FIG. 2, is provided between a document tray 11, the recording paper supply tray 8 and the image reading portion 28, the image recording portion 1A, and the recording paper transport path R1 and the document transport path R2 are adapted to join each other upstream of this control substrate 500.

As described above, the control substrate 500 is provided between the original tray 11, the recording paper supply tray 8 and the image reading portion 28, the image recording portion 1A, and the recording paper transport path R1 and the document transport path R2 are adapted to join each other upstream of the control substrate 500, whereby the document 12 can be transported without interfering with the control substrate 500 and the movement area of the ink cartridge 1. In other words, the document transport path R2 can be provided without interfering with the control substrate 500 and the movement area of the ink cartridge 1, whereby the downsizing of the facsimile apparatus 100 becomes possible.

Figure 12:
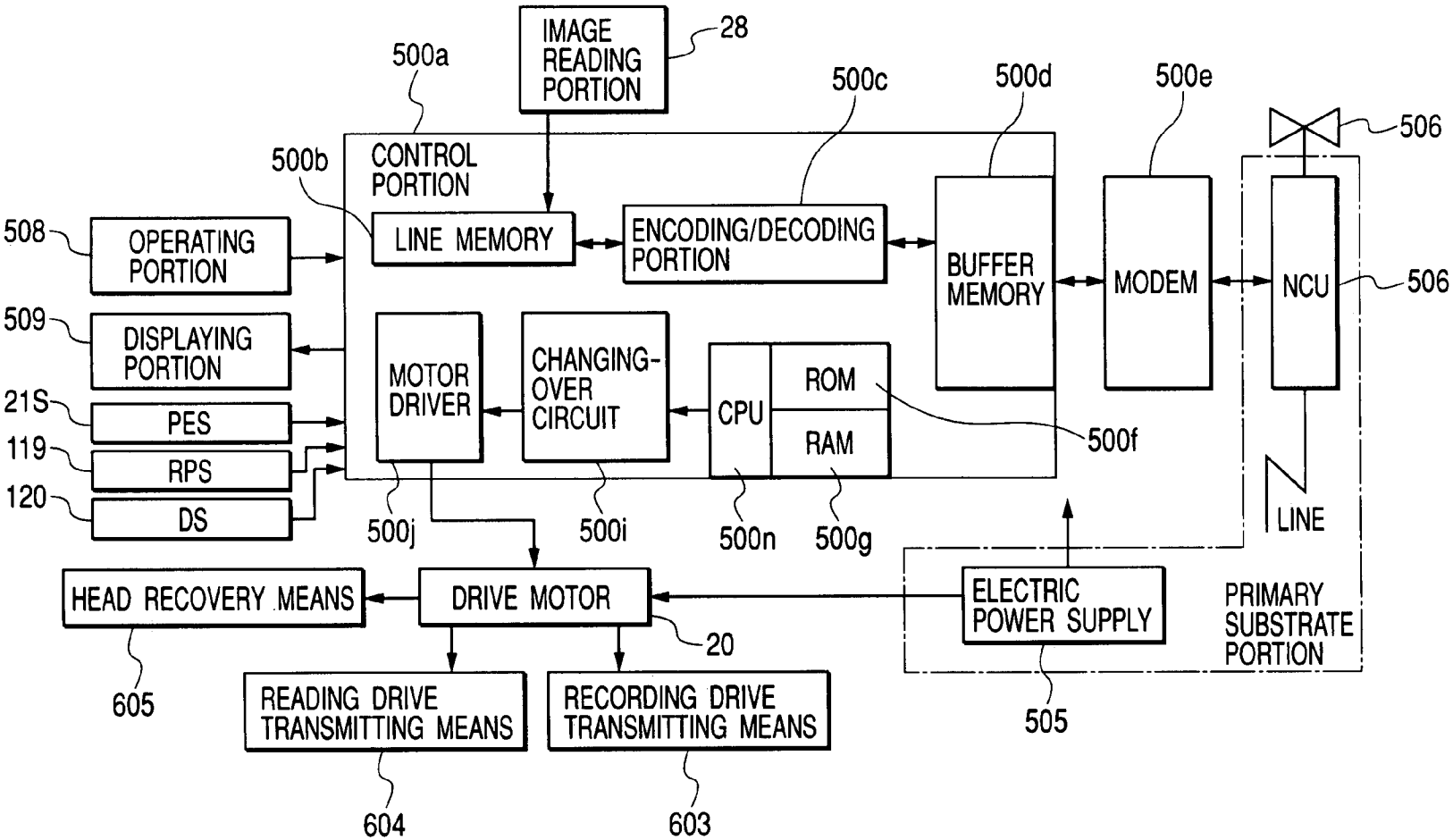
FIG. 12 is a control block diagram of the facsimile apparatus.

FIG. 12 is a control block diagram of the facsimile apparatus 100 according to the present embodiment. In FIG. 12, the reference character 500*a* denotes a control portion mounted chiefly on the control substrate 500, and this control portion is connected to the already described electric power supply 505, the NCU substrate 504 to which a telephone 506 and its line are connected, the display portion 509 for displaying a substance or the like inputted from the operating portion 508, the image reading portion 28, the drive motor 20, the carriage driving motor 33 and the PES 21S for detecting the leading edge and trailing edge of the recording paper 2, and to a roller position sensor (RPS) 119 for detecting the rotational phase of the recording paper separating roller 19, a document sensor (DS) 120 for detecting the presence or absence of the document 12, etc. A module (not shown) is mounted on the NCU substrate 504.

Also, this control portion 500*a* has a CPU 500*n* for effecting the control of the entire apparatus, a ROM 500*f* storing various programs and various data therein, a RAM 500*g* used as the work area of the CPU 500*n* and also effecting the temporary preservation of various data including the number of recorded sheets, etc., a buffer memory 500*d* storing therein transmitted and received encoded image data, an encoding/decoding portion 500*c* for encoding image information to be transmitted by MH encoding or the like, and decoding the received encoded image data and converting it into image data, a line memory 500*b* storing therein the image of each line of the image data, etc.

This line memory 500*b* are designed such that in the case of the transmission or copying of the document, image data corresponding to one line from the image reading portion 28 is stored therein, and in the case of the reception of image data, decoded image data corresponding to one line is stored therein, and design is made such that the various data stored in this line memory 500*b* are outputted to the image recording portion 1A, whereby image recording is effected.

In the present embodiment, a constant current type pulse motor is used as the drive motor 20, and the driving of this drive motor 20 is effected by a signal outputted from the output port of the CPU 500*n* being converted into a phase signal through a motor driver 500*j*, and transmitted to the drive motor 20.

In the present embodiment, design is made such that the transporting operation for the recording paper 2, the already described head recovery operation, and the image reading operation of feeding and transporting the document 12 and at the same time, moving the image reading portion 28 as will be described later are performed by this drive motor 20, thereby achieving a reduction in cost.

The control portion 500*a* which is controlling means for controlling the drive motor 20 so that the transporting operation for the recording paper 2, etc. can be performed by a single drive motor 20 as described above is adapted to changeover-control drive changing-over means (not shown) to thereby selectively transmit the drive of the drive motor 20 to one of reading drive transmitting means 604, recording drive transmitting means 603 and head recovery means 605.

However, as will be described later, the transport of the recording paper 2 requires the feeding accuracy for each one line, and the necessary torque differs between the image reading operation and the recording operation/recovery operation. So, the control portion 500*a*, when it enters the image reading operation, sends a changeover signal from the port of the CPU 500*n* to a changing-over circuit 500*i* having a circuit construction shown in FIG. 14 which will be described later, and changes a reference current value to a driver 500*j* to thereby change over the peak current of the driving current of the drive motor 20.

Description will now be made of the image recording operation of the image recording apparatus portion 101 constructed as described above.

When an image signal is inputted from an external device, not shown, the recording paper separating roller 19 is rotated in the direction indicated by the arrow shown in FIG. 9, and along therewith, the pressure plate 9 is moved up by the action of a cam, not shown, formed integrally with the recording paper separating roller 19, and the recording paper 2 comes into contact with the outer peripheral surface of the recording paper separating roller 19. Thereby, the uppermost recording paper 2*a* on the recording paper supply tray 8 which is in contact with the recording paper separating roller 19 is transported over the separating pawl 31 and to the common transport path 49 by the friction thereof with the recording paper separating roller 19.

Next, the recording paper 2*a* thus transported to the common transport path 49 is nipped between the transporting roller 10 journalled to the platen 3 and the four pinch rollers 16, as shown in FIG. 9, and passes a recording paper supporting surface which is the upper surface of a supporting portion constituted by the platen 3 and the auxiliary platen member 3*a*.

When the recording paper 2*a* thus passes the recording paper supporting surface, the ink is discharged from the ink jet cartridge 1 carried on the carriage 4 scanning (reciprocally moved) in the widthwise direction of the recording paper 2*a*, in conformity with image information, whereby an image is recorded on the recording paper. After the image has been thus recorded, the recording paper 2*a* is delivered out of the apparatus by the delivery roller 17, as indicated by the arrow P.

Now, when the image is thus recorded in the image recording portion 1A, when recording of one line is terminated on the recording paper 2, the recording operation (ink discharge) is interrupted and the recording paper 2 is fed by a predetermined amount in a direction (sub-scanning direction) perpendicular to the direction of movement of the carriage 4, and the image of the next line is recorded while the carriage 4 is again moved (caused to main-scan).

The feeding (transport) of the recording paper 2 is effected by the transporting roller 10 connected to the drive motor 20 being rotated by a predetermined amount, but if the amount of rotation of the transporting roller 10 becomes unstable due to a cause such as the faultiness of the motor and for example, the amount of rotation becomes excessive, a white blank portion will form in an image, and if the amount of rotation is deficient, the inconvenience of the overlap with the preceding line (black streak) will occur. Therefore, as already described, the amount of rotation of the transporting roller 10 requires high accuracy.

In the present embodiment, the printing operation for the recording paper 2 uses one side portion (right side portion) 35*b* of the base member 35 in FIG. 3 as the recording reference. Also, a first recording paper separating roller portion 19*a* of the recording paper separating roller 19 is disposed at a location near this one side portion 35*b*, e.g. distant by about 43 mm from the one side portion 35*b*, and a second recording paper separating roller portion 19*b* thereof is disposed at a location distant by about 189 mm from the one side portion 35*b* so as to sandwich the document separating roller 15. By thus disposing the first recording paper separating roller portion 19*a* and the second recording paper separating roller portion 19, it is possible to cope with the recording paper 2 of various sizes from postcard size to A4 size.

The image reading apparatus portion 102 will now be described.

The image reading apparatus portion 102 is provided with the image reading portion 28 which will be described later, and in addition, a document tray 11 which is second stacking means capable of containing a plurality of documents 12, and a document feeding portion 40 for transporting the documents 12 set on the document tray 11 to the image reading portion 28, as shown in FIGS. 1 and 10, and this document feeding portion 40 is disposed upstream of the recording paper feeding portion 600 with respect to the transport direction of the document, and has a document separating roller 15 which is second sheet feeding means, and a document feeding runner 52, a document transporting roller S, a document upper guide 14, etc. for transporting the separated document further downstream.

A sheet feeding apparatus 103 for feeding the document 12 and the recording paper 2 to the image reading portion 28 and the image recording portion 1A is constituted by the document tray 11, the document separating roller 15, etc. and the already described recording paper supply tray 8, the recording paper separating roller 19, etc.

In FIG. 10, the reference numeral 501 designates a runner supporting metal plate provided between the control substrate 500 and the document feeding portion 40 for supporting the document feeding runner 52 for contacting with a document transporting roller 51 which is the sheet transporting roller of the present invention to thereby transport the document 12 separated by the document feeding portion 40 further downstream, and this runner supporting metal plate 501 is disposed so as to have its opposite ends supported by the base member 35. Also, this runner supporting metal plate 501 serves to hide the document separating roller 15 and the document transporting roller 51 having rubber of low flame retardancy from the control substrate 500.

The document transporting roller 51 is disposed between the document separating roller 15 and the transporting roller 10, has a cylindrical frictional elastic member mounted on a shaft member formed of a metal, and is rotatably journalled to the base member 35, and one end of the shaft is connected to the reading drive transmitting means 604 (see FIG. 12). That is, the document transporting roller 51 is driven by the drive motor 20. Also, the document feeding runner 52 is biased toward the document transporting roller 51 by a document feeding runner spring (not shown) and gives birth to a document transporting force.

Figure 13:
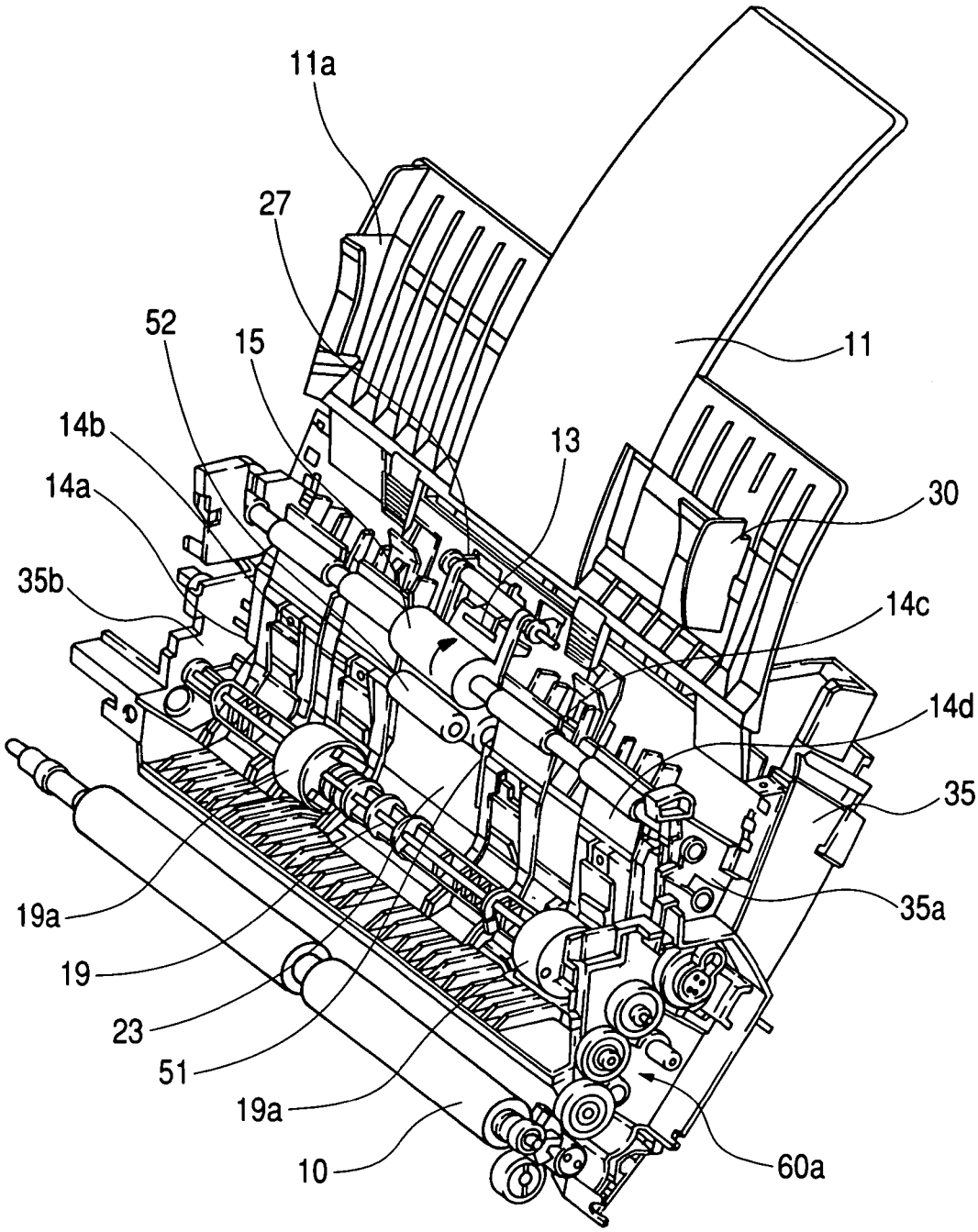
FIG. 13 is a perspective view illustrating the construction of the recording paper and document feeding system of the facsimile apparatus.

The document feeding portion 40 uses one side of the document 12 as the reference, and in the present embodiment, as shown in FIG. 13, the inner wall of the left side plate 11*a* of the document tray 11 is the document reference.

The document separating roller 15 is formed with a cylindrical frictional elastic member mounted on a shaft member 15*a* formed of a metal, and is rotatably journalled to the opposite side portions 35*a* and 35*b* of the base member 35, as shown in FIG. 3. One end of the shaft 15*a* of this document separating roller 15 is connected to the drive motor 20 (see FIG. 4) through the reading drive transmitting means 604 (see FIG. 12) and drive changing-over means (not shown).

This drive changing-over means, as already described, is adapted to be changed over by the control portion 500*a* (see FIG. 12), and in the case of the image recording operation, transmit the drive of the drive motor 20 to the recording drive transmitting means 603 to thereby drive the recording paper separating roller 19, and in the case of the image reading operation, transmit the drive of the drive motor 20 to the document separating roller 15 and the image reading portion 28 through the reading drive transmitting means 604.

Further, the document separating roller 15, as already described, is disposed between the roller portions 19*a* and 19*b* of the recording paper separating roller 19 (see FIG. 3), and in the present embodiment, substantially centrally in the widthwise direction of the document, and by the document separating roller 15 being disposed at such a location, the skew feed of the document 12 can be mitigated.

In FIG. 5, the reference numeral 13 designates a separating piece brought into pressure contact with the document separating roller 15 by a separating spring 37*a*, and this separating piece 13 is formed of a material of a high coefficient of friction such as rubber, and is held by a separating piece supporting member 37 pivotally supported on a document lower guide member 23 for directing the document 12 fed out by the document separating roller 15 toward the common transport path 49. Also, the reference numeral 27 denotes an auxiliary document transporting member for urging the document 12 against the document separating roller 15 to thereby perform an auxiliary operation for the separation of the document.

When the documents 12 are set on the document tray 11 provided with such a separating piece 13, etc., the documents 12 have their leading edges stopped by a wedge shape formed by the separating piece 13 and the document separating roller 15, and when the document separating roller 15 is thereafter rotated, only the uppermost document 12*a* of the documents 12 stopped by the wedge shape is transported by the friction thereof with the document separating roller 15.

Now, the separating piece 13 is biased against the document separating roller 15 by the separating spring 37*a* and therefore, the document 12 is transported while receiving the load by the document separating roller 15 and the separating piece 13. When the document 12 is thus transported while receiving the load, load torque increases and a stretched image will come to occur.

So, in the present embodiment, a document transporting roller 51 which is intermediate feeding means is disposed between the document separating roller 15 and the transporting roller 10, as shown in FIG. 10, and as already described, during the image recording operation, for example, a changeover signal is changed over from High to Low to thereby drive the drive motor 20 by motor torque higher than during the recording paper transport, whereby the transporting force of the document transporting roller 51 is adapted to become higher than the load.

As described above, the document transporting roller 51 is disposed between the document separating roller 15 and the transporting roller 10, and the transporting force of the document transporting roller 51 is made greater than the load, whereby the stretched image can be prevented.

Figure 14:
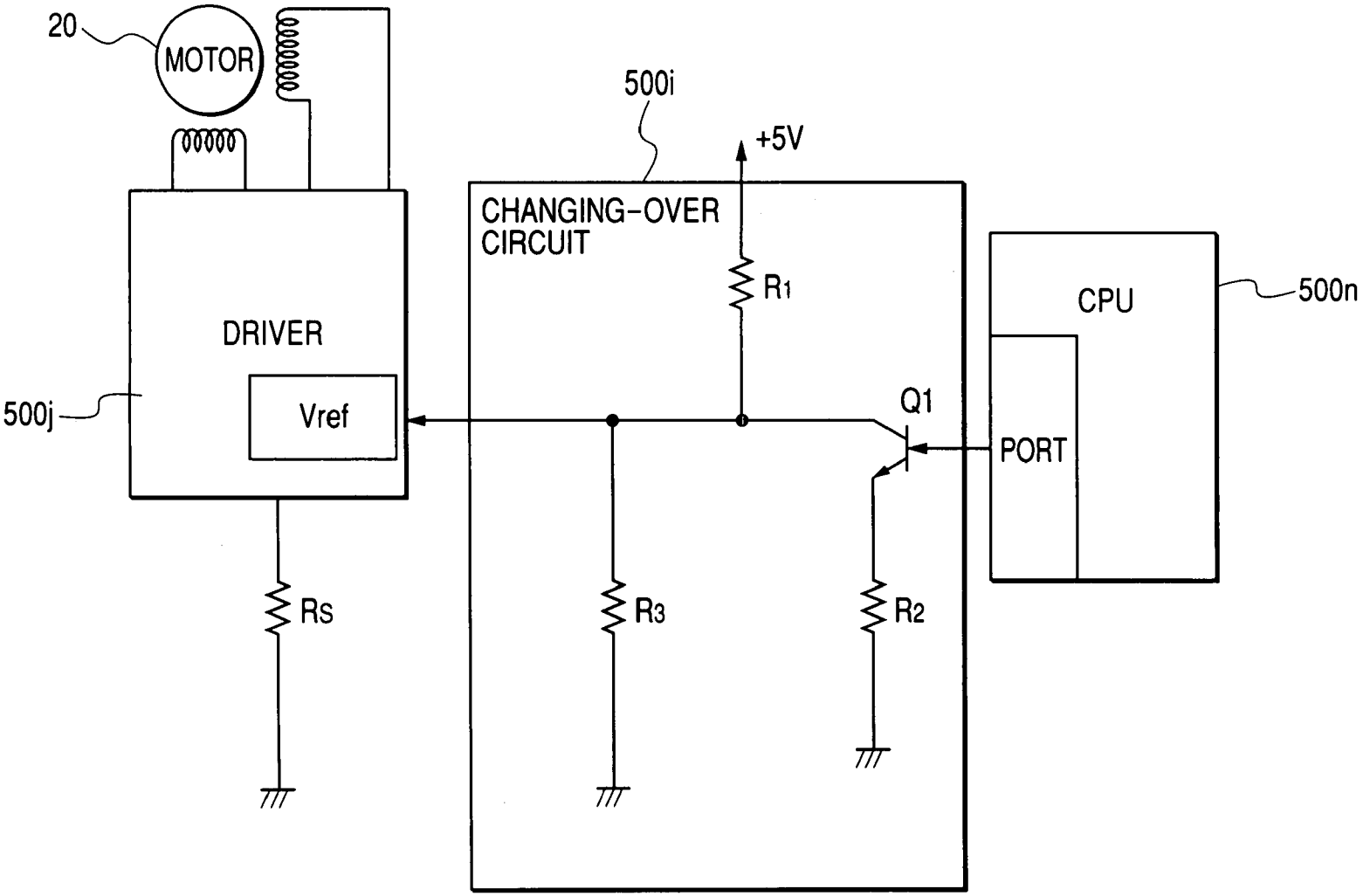
FIG. 14 shows the construction of a changing-over circuit provided in the control portion of the facsimile apparatus.

Now, FIG. 14 shows the construction of the changing-over circuit 500*i* disposed between the CPU 500*n* (see FIG. 12) and the drive motor to effect the changeover of the peak current (value) of the driving current of such a drive motor 20, and as shown in FIG. 14, the changing-over circuit 500*i* is comprised of a transistor Q1 and three resistors R1-R3.

In the present embodiment, the resistor R1 is set to 1.5 kΩ, the resistor R2 is set to 2.2 kΩ, and the resistor R3 is set to 1.5 kΩ. Also, Rs designates a current value detecting resistor connected to the driver 500*j*, and this current value detecting resistor Rs is set to 0.51 kΩ.

Here, a peak current value PA, i.e., a motor current value (A), applied to the drive motor 20 is represented by the following expression, for example, in the present embodiment when a reference voltage to the driver 500*j* is defined as Vref.

$$PA = Vref/(10 \times Rs) \quad \ldots \text{ (10 is a constant)}$$

Also, during the recording operation and during the recovery operation, the changeover signal from the port in the CPU is High as already described, whereby the transistor Q1 is in its ON state.

When in this state, it is assumed that R0=(R2×R3)/(R2+R3), Vref is 1.86V[=5V×R0/(R0+R1)] and therefore, the motor current value PA is about 0.36 mA from the foregoing expression.

On the other hand, during the reading operation, the CPU 500*n* renders the changeover signal from the port Low, and renders the transistor Q1 OFF. Vref at this time is 2.5V [=5V×R3/(R1+R3)] and therefore, the motor current value PA is about 0.49 mA.

As described above, the changeover signal from the CPU 500*n* is rendered High during the recording operation and during the recovery operation, and is rendered Low during the image reading operation, and the reference voltage to the driver 500*j* is changed to thereby change over the peak current value of the drive motor 20. By effecting such current control conforming to the necessary torque, silencing becomes possible and also, the step-out of the drive motor 20 can be prevented.

Also, a document upper guide 14 is disposed above the document lower guide member 23 which is a lower guide member and constitutes the upper surface of the document transport path R2, and this document upper guide 14 which is an upper guide member is formed into a strip shape, and has its upper end pivotally supported on the shaft portion 15*a* of the document separating roller 15, as shown in FIG. 5, and hangs down onto the document lower guide 23 from gravity and constitutes the upper surface of the document transport path R2.

This document upper guide 14 is formed of resin or the like having good slidability and is light in weight, and is pivotally movable about the shaft portion 15*a* of the document separating roller 15 with a light force and therefore, when the document 12 is being transported between the document upper guide 14 and the document lower guide member 23 by the document transporting roller 51 or the transporting roller 10, the document upper guide 14 is adapted to be pushed upwardly with the document separating roller 15 as the center of rotation by the stiffness of the document 12 and the fluttering of the leading edge or the trailing edge thereof. By the document upper guide 14 being thus pushed up, the document transport path R2 is secured.

When the document upper guide 14 is thus pushed up, the document upper guide 14 is upwardly flexed (deformed) and the upper surface of the lower portion thereof comes into contact with the shaft portion 19*c* of the recording paper separating roller 19, but design is made such that even in a state in which the document upper guide 14 is thus in contact with the shaft portion 19*c* of the recording paper separating roller 19, the guide surface of the document upper guide 14 is located more toward the document transport path R2 than the cut-away portion 19A of the recording paper separating roller 19.

That is, even if the document upper guide 14 is pushed up by the document 12 when the document 12 is transported, the document upper guide 14 comes to be positioned at a location whereat the recording paper separating roller 19 does not contact with the document 12, by (the shaft portion 19*c* of) the recording paper separating roller 19. Thus, when the document 12 is transported, the recording paper separating roller 19 does not contact with the document 12 and does not hamper the transport of the document 12.

Also, the recording paper separating roller 19, as already described, has its shaft portion. 19*c* formed of a flexible material such as plastic and therefore, the recording paper separating roller 19 may sometimes be downwardly flexed by its own weight, but even in such a case, the document upper guide 14 contacts with the shaft portion 19*c* of the recording paper separating roller 19 in its flexed state and therefore, the relative positional relation between the recording paper separating roller 19 and the document upper guide 14 is maintained, and it never happens that the cut-away portion 19A of the recording paper separating roller 19 protrudes into the document transport path R2. Thereby, the document 12 is fed reliably and stably without contacting with the recording paper separating roller 19.

Further, as already described, the roller guide 63 formed of a low-friction material is attached to the cut-away portion 19A of the recording paper separating roller 19 and therefore, faulty transport can be prevented even when the document 12 contacts with the roller portion 19*a* of the recording paper separating roller 19.

Figure 15:
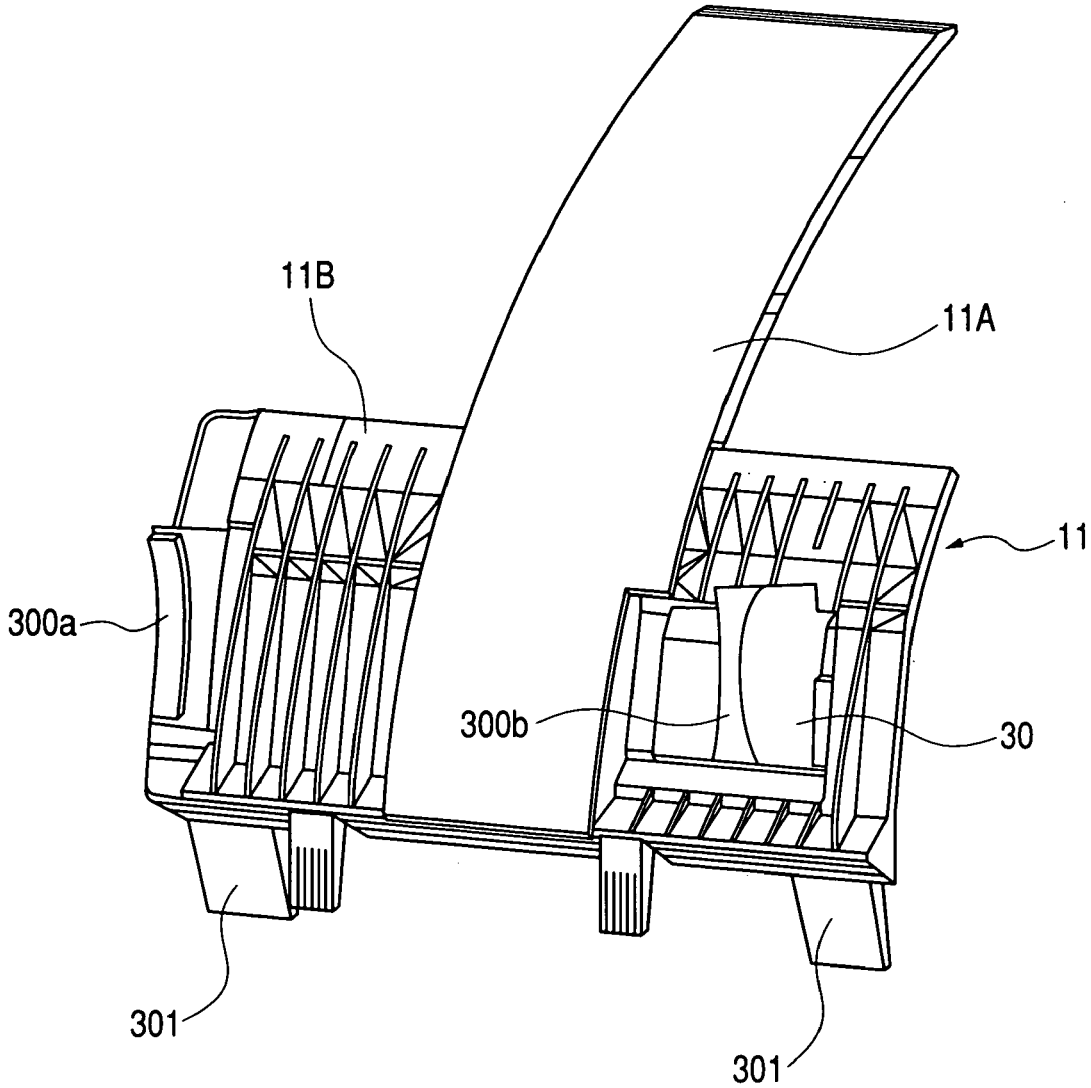
FIG. 15 is a perspective view illustrating the document tray of the sheet feeding apparatus.

A document slider 30 which is regulating means for effecting the position regulation of the document 12 in the widthwise direction thereof orthogonal to the document transport (feed) direction, and preventing the skew feed of the document 12 is provided on the document tray 11 for movement in accordance with the width of the document, as shown in FIG. 15. Also, in FIG. 15, the reference character 11A designates the document stacking portion of the document tray 11, and the reference character 11B denotes a document supporting portion provided on the document tray 11 to support the upper portion of the document, and the document stacking surface of the document tray 11 is constituted by the document stacking portion 11A and the document supporting portion 11B.

The image reading portion 28, as shown in FIG. 7, is disposed between the transporting roller 10 and the delivery roller 17 and in the movement route of the carriage 4 so as to be opposed to the platen 3, and is adapted to read the upper surface of the document 12 being transported, and by the image reading portion 28 being thus provided in the movement route of the carriage 4, the downsizing of the facsimile apparatus 100 can be achieved.

In other words, the image reading portion 28 and the image recording portion 1A are juxtaposed, and during the reading operation, the image reading portion 28 is moved into the movement area of the carriage 4 (image recording portion 1A), and during the image recording operation, the image reading portion 28 is moved to a standby position outside the movement area of the carriage 4, whereby the movement space of the carriage 4 can be effectively used not only during recording but also during image reading, whereby the downsizing of the apparatus can be achieved.

This image reading portion 28 is provided with a contact image sensor (hereinafter referred to as a CS) 22 which is image reading means, a CS holder 26 which is a holding member for holding the CS 22, and a white reference member 25 held by the CS holder 26 while being opposed to the CS 22.

The CS 22 is contained in a recess formed in the CS holder 26 so that the sensor surface thereof may be outer, and is fixed by a screw (fastening member) (not shown). Also, the white reference member 25 is formed by a white sheet attached to a metal plate, which is provided with a flat surface to which the white sheet is attached, and bent portions formed on the lengthwisely opposite end portions thereof.

These bent portions are formed with apertures, and a shaft formed in the CS holder 26 is engaged with these apertures to thereby support the white reference member 25 for pivotal movement relative to the CS holder 26 and the CS 22. This white reference member 25 is biased toward the CS side by a torsion coil spring (not shown).

Also, this white reference member 25 has, on the outer side thereof in the widthwise direction of the document, a projection (not shown) abutting against the CS 22 while being biased against the CS 22, and by this projection, a gap G1 (reading transport path) enabling at least one document to pass therethrough is adapted to be formed between the sensor surface of the CS 22 and the white sheet of the white reference member 25.

Now, the white reference member 25 cooperating with the CS 22 to form the reading transport path can assume a normal position in which it is biased by the torsion coil spring to thereby form the gap G1 enabling at least one document to pass therethrough, and a cleaning position in which against the torsion coil spring, the white reference member 25 has been pivotally moved away from the CS 22.

When the white sheet of the white reference member 25 or the reading surface of the CS 22 is stained with the ink of the image recording portion 1A, the user can move the white reference member 25 to the cleaning position to thereby simply clean the stained portion.

Figure 16:
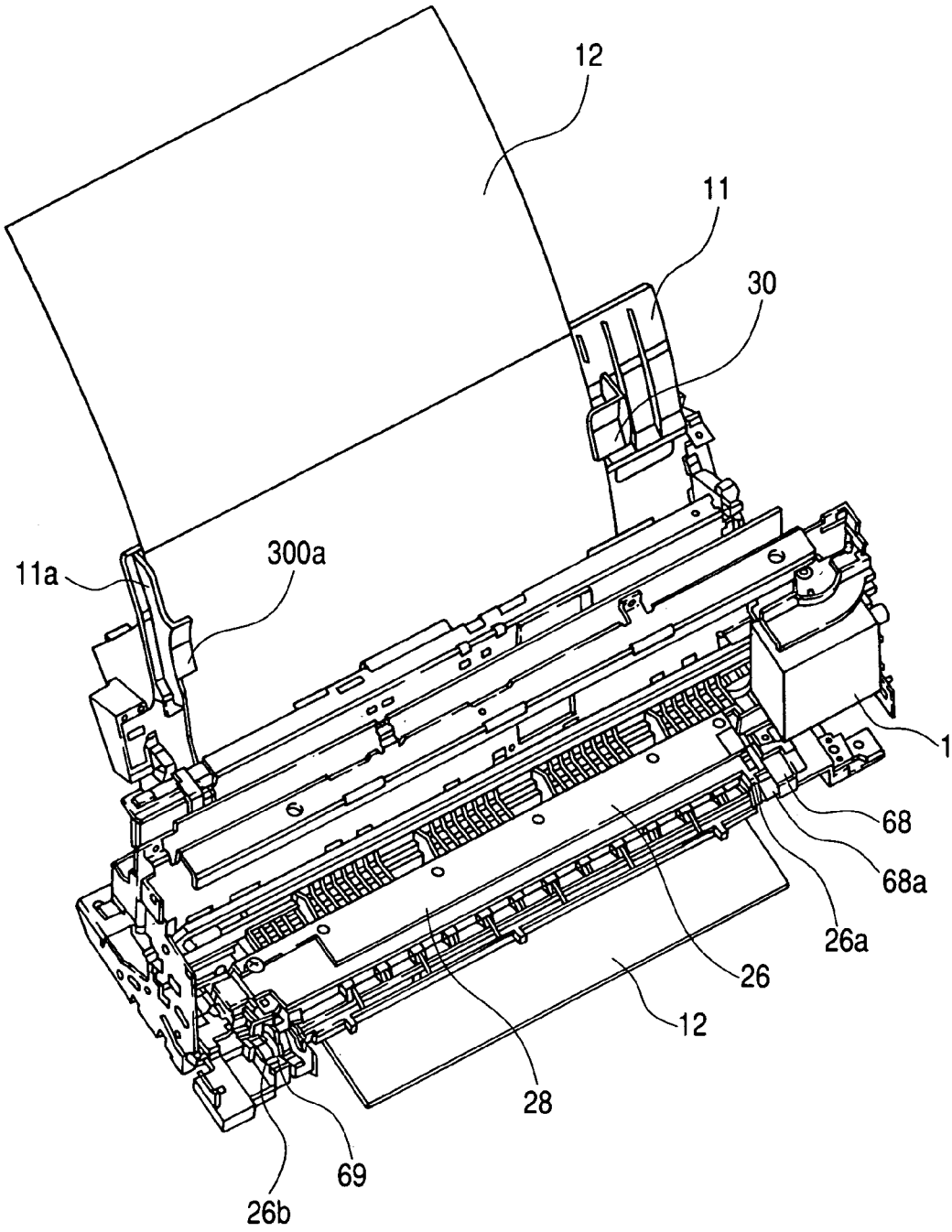
FIG. 16 is a perspective view showing the position of an image reading portion and the flow of a document during the image reading operation in the facsimile apparatus.

A hollow boss 26*a* is formed on one side wall surface of the CS holder 26 in the lengthwise direction thereof, and a boss 68*b* is formed on the other side wall surface of the CS holder 26, and a boss 68*a* formed on a CS holder supporting member 68 mounted on the platen 3 as shown in FIG. 16 is engaged with the hollow boss 26*a* on the one side wall surface, and a bearing portion 69 formed on the platen 3 is engaged with the boss 68*b* formed on the other side wall surface.

These right and left engaging portions are on the same shaft, whereby when in the case of image recording shown in FIG. 9, the carriage 4 has been moved in the scanning direction, the CS holder 26 is adapted to be movable from a first position (standby position) in which it does not contact with the carriage 4 to a second position (reading position) shown in FIG. 2 wherein a document reading transport path formed in the movement space of the carriage 4 by the gap between the reading surface of the CS 22 and the white reference member 25 and the recording paper supporting surface formed by the platen 3 are flush with each other.

Further, the horizontal position of the CS holder 26 is designed such that in a state in which, when viewed from the delivery direction, the ink cartridge 1 is in the capping position (see FIG. 8) at one end (right end) within the movement range of the carriage, the CS holder 26 can be moved to the second position.

Also, the upstream side of the metal plate of the white reference member 25 with respect to the document transport direction is of a comb-tooth shape, and the ribs 38 of the platen are adapted to come into among the comb teeth, and a bent portion for increasing the strength in the lengthwise direction is formed on the downstream side of the metal plate of the white reference member 25 with respect to the document transport direction.

When the CS holder 26 is to be moved to the second position, this bent portion pushes down the auxiliary platen member 3*a* pivotally supported as already described, whereby the CS holder 26 can be moved to the second position. Thereby, during document reading, the reading transport path formed between the transporting roller 10 and the delivery roller 17 by the white reference member 25 and the CS 22 and the recording paper supporting surface formed by the platen 3 become flush with each other.

Figure 17:
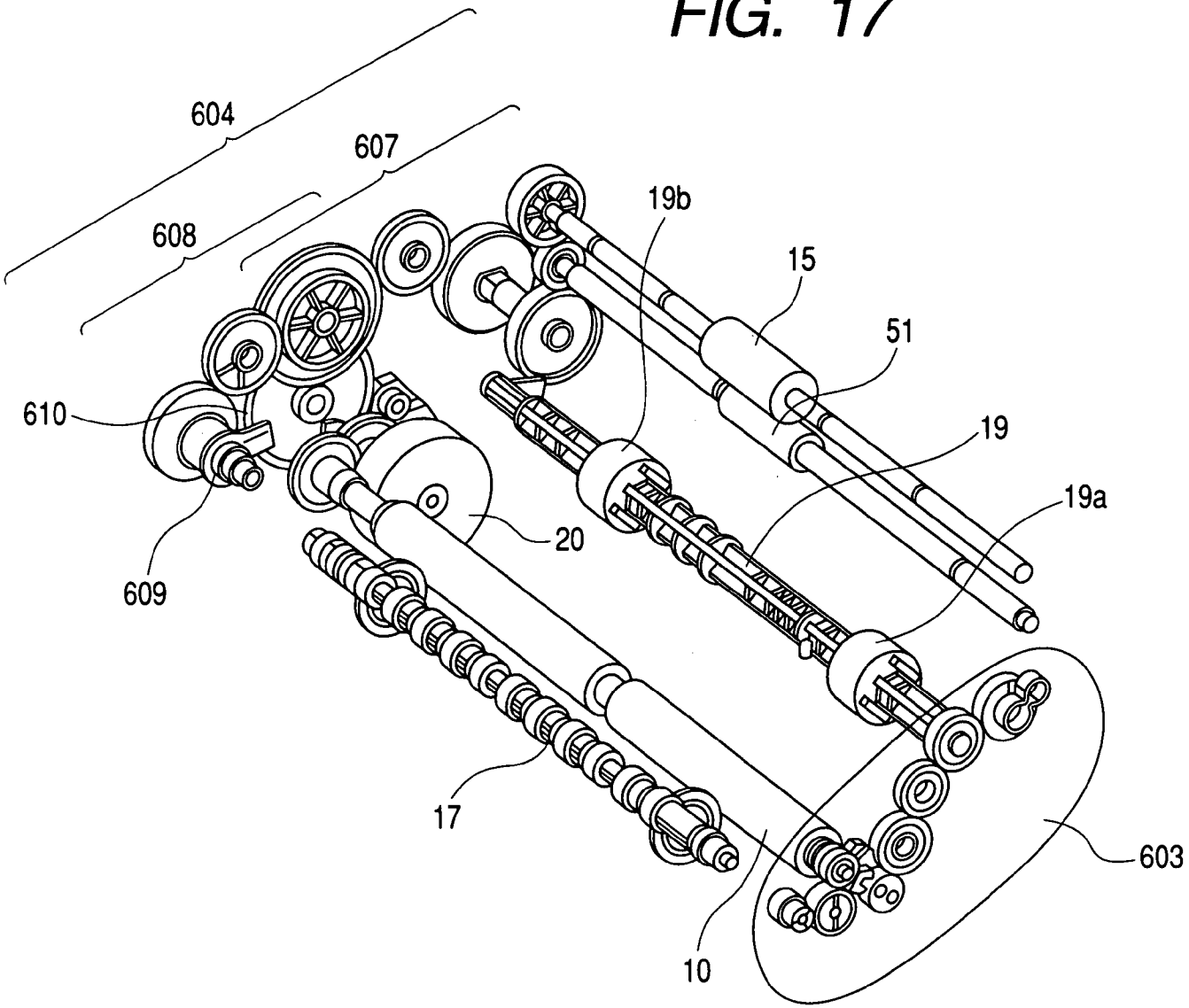
FIG. 17 is a perspective view showing the positional relation between a roller and drive transmitting means in the sheet feeding apparatus.

Also, on one end portion (widthwisely left end portion) of the CS holder 26, there is disposed CS driving means 609 connected to the drive motor 20 through drive changing-over means (not shown) and CS drive transmitting means 608 shown in FIG. 17, and the CS holder 26 can be moved to the first position or the second position by the drive of the drive motor 20 through the CS driving means 609.

For example, the CS holder 26 is biased in a counter-clockwise direction as viewed in FIG. 1 by a CS push-up spring (resilient member) so as to be held in the first position in the standby state of the apparatus, but when the image reading operation is started, the drive of the drive motor 20 is transmitted to the reading drive transmitting means 604 by the drive changing-over means, whereby the document transport driving means 609 rotates the document separating roller 15 to thereby perform the document feeding operation, and also the CS drive transmitting means 608 rotates a push-down spring 610 provided on the shaft of the CS driving means 609 in a clockwise direction as viewed in FIG. 1, and moves the image reading portion 28 to the second position by such torque as overcomes the reaction force of the CS push-up spring.

The CS driving means 609 utilizes the sliding torque of a spring clutch and therefore, when a certain phase is reached, the clutch is disconnected so that the image reading portion 28 may be pushed in a clockwise direction as viewed in FIG. 1 by constant torque. By the gear ratio between the document transport transmitting means 607 and the CS drive transmitting means 608 and the roller diameter being adjusted, the CS holder is set so as to be moved to the CS holder second position (reading position) before the document 12 arrives at the transporting roller 10.

Description will now be made of the image reading operation of the image reading apparatus portion 102 constructed as described above.

When the reading operation is started with the document 12 set on the document tray 11, the drive changing-over means is first changed over by the control portion (see FIG. 12) to thereby transmit the drive of the drive motor 20 to the document separating roller 15 and the document transporting roller 51 through the reading drive transmitting means 604. Thereby, the document separating roller 15 and the document transporting roller 51 are rotated in the direction indicated by the arrow shown in FIG. 2, and the documents 12 set on the document tray 11 are separated and fed out one by one by the thus rotated document transporting roller 51 and document separating roller 15 and the separating piece 13.

At this time, the phase of the recording paper separating roller 19 disposed downstream of the document separating roller 15 with respect to the feeding direction as already described in the rotational direction thereof is in its initial state, and the gap G sufficient to pass a document therethrough is formed between the cut-away portion 19A of the roller portion 19*a* of the recording paper separating roller 19 and the document lower guide member 23 (see FIG. 5).

Also, the document separating roller 15 is thus rotated and also the CS driving means 609 is operated through the CS drive transmitting means 608, and the CS holder 26 held in the first position (standby position) as shown in FIG. 9 in the standby state of the apparatus is pivotally moved in the direction indicated by the arrow.

When the CS holder 26 is thus moved to the second position, the clutch connecting the CS driving means 609 and the CS drive transmitting means 608 together is disconnected and the CS holder 26 is stopped, and also is biased in that position by the CS push-down spring 610. Also, at the same time, the CS holder 26 pushes down the auxiliary platen member 3*a*, whereby a reading transport path flush with the recording paper supporting surface constituted by the platen 3 is formed between the transporting roller 10 and the delivery roller 17.

Next, the document 12 separated and fed out one by one, like the recording paper 2, is guided by the platen 3, the pinch roller guide 36 and the upper guide 42 with the underside thereof supported by the document lower guide member 23, and is transported to the nip between the transporting roller 10 and the pinch rollers 16 while depressing the PE sensor lever 21.

When the PES lever 21 is thus depressed, a detection signal is inputted from the PES 21S to the control portion, which in turn detects the leading edge of the document 12 on the basis of this detection signal, and finds the reading position on the document 12.

Next, the document 12 transported to the transporting roller 10 and the pinch rollers 16 is nipped by the transporting roller 10 and the four pinch rollers 16, and passes the reading transport path formed by the CS 22 and the white reference member 25 and has its image data read by the CS 22 during this passage. When the most trailing edge of the document 12 is read, the document 12 is delivered out of the apparatus by the delivery roller 17.

When the document 12 is thus delivered, the drive motor 20 is reversely rotated, whereby the CS driving means 609 and the CS drive transmitting means 608 are connected together by the clutch, and the CS holder 25 is moved to the first position by the already described CS push-up spring.

Also, with the movement of this CS holder 26 to the first position, the auxiliary platen member 3*a* is pushed up by the biasing force of the spring 58, whereby a flush recording paper supporting surface is formed by the recording paper supporting surface of the auxiliary platen member 3*a* and the recording paper supporting surface of the platen 3. Lastly, the drive of the drive motor 20 is changed over to a recording mode by the drive changing-over means, and the apparatus assumes a standby state.

Now, in the present embodiment, the separating piece 13 cooperating with the document separating roller 15 to separate and feed out the documents 12 set on the document tray 11 one by one is disposed in a space avoiding the interference with the document lower guide member 23, the recording paper separating roller 19 and the control substrate 500 fixed to the back of the printer chassis, as shown in FIG. 1.

Figure 18:
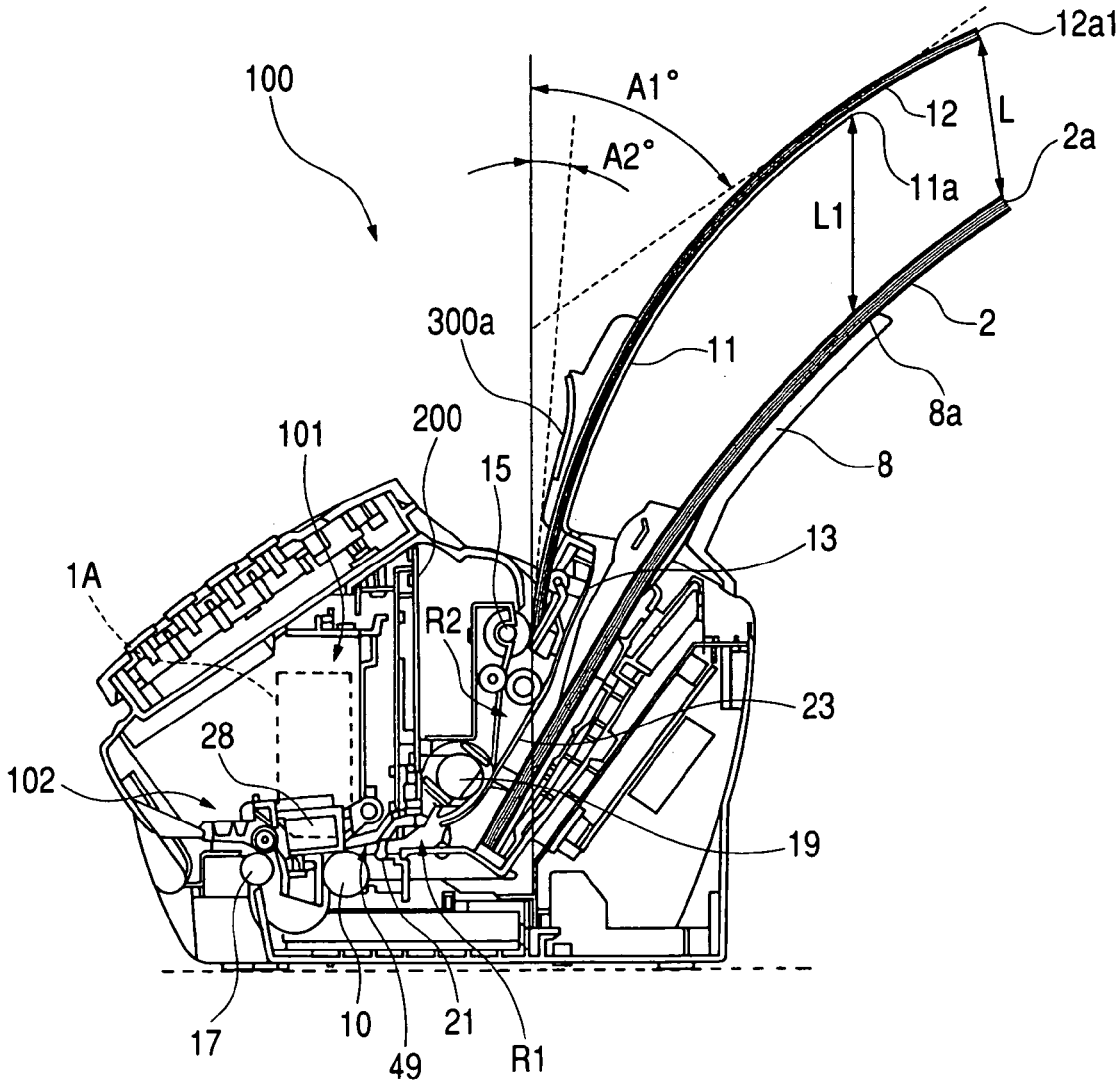
FIG. 18 is a cross-sectional view illustrating the details of the document tray of the sheet feeding apparatus.
Figure 19:
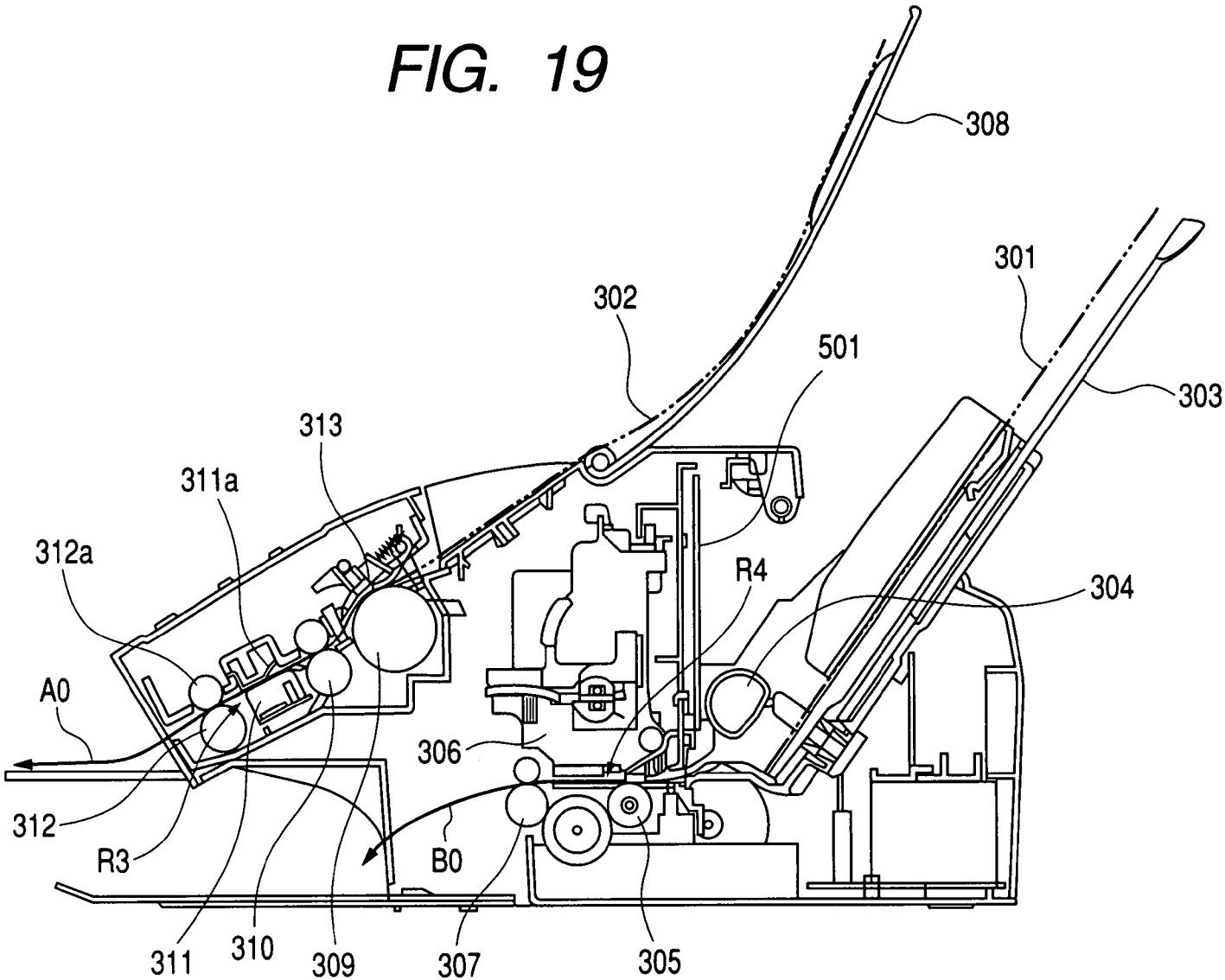
FIG. 19 is a cross-sectional view illustrating the construction of a conventional facsimile apparatus.

Moreover, to prevent the document 12 from protruding from the apparatus as much as possible, it is preferable for this separating piece 13 to be disposed at the lowest possible position in this space. When the separating piece 13 is disposed at such a position, the angle of the separating piece 13 becomes nearly parallel to the stacked recording paper 2, as shown in FIG. 18. In the present embodiment, the separating piece 13 is disposed so as to form an angle of about 60° with respect to a horizontal plane.

On the other hand, when the separating piece 13 is disposed at such an angle, to prevent the double feed or the like of the document 12, it is necessary that the entry angle of the leading edge of the document be an angle sharper by 10° to 30° than the angle of the separating piece 13, i.e., 70° to 90° with respect to the horizontal plane. When the entry angle of the leading edge of the document is such a sharp angle, there is the possibility that the load of the document itself concentrates in the leading edge portion of the document 12, whereby the document 12 is outwardly flexed and buckled on the document tray 11 from gravity or the upper end portion thereof is inclined forwardly (toward the document separating roller side).

So, in the present embodiment, the document stacking surface of the document tray 11 constituted by a document stacking portion 11A and a document supporting portion 11B shown in FIG. 15 is formed so that an angle A1 formed with respect to the vertical direction by the upper end of the document stacking surface (document supporting portion 11B) may be greater than an angle A2 formed with respect to the vertical direction by the lower end of the document stacking surface (document stacking portion 11A).

As described above, the document stacking surface of the document tray 11 is made into such a round (curved) shape that for example, the angle gradually becomes from the angle A2 to the angle A1 so that the upper end portion side may be greater in the angle formed with respect to the vertical direction than the lower end portion side, whereby it never happens that the load of the document itself concentrates in the leading edge portion of the document 12. Thereby, the possibility that the document 12 is buckled or is inclined forwardly becomes null, and as the result, the stacking performance for the documents 12 can be maintained and the documents 12 can be fed reliably.

This effect arises if the angle difference (A1–A2) between the angle A1 of the lower end of the document stacking surface near the separating portion and the angle A2 of the upper end of the document stacking surface is 20° or greater, but if this angle different is 70° or greater, the smooth feeding of the document 12 becomes difficult. Therefore, in the present embodiment, this angle difference (A1–A2) is about 50°, whereby the document 12 can be smoothly fed.

Even when as described above, the separating piece 13 is disposed at an angle of about 60° with respect to the horizontal plane and the document tray 11 is disposed so that the angle difference (A1–A2) may be about 50°, as shown in FIG. 18, the angle formed with respect to the vertical direction by the lower end portion of the document stacking surface of the document tray 11 is made smaller than the angle formed with respect to the vertical direction by the lower end portion of the sheet stacking surface of the recording paper supply tray 8. Thereby, the documents 12 can be set on the document tray 11 without being hindered by the recording paper 2 stacked on the recording paper supply tray 8, and also the downsizing of the apparatus becomes possible.

Now, in the present embodiment, the document tray 11 is formed of a transparent material, whereby the presence or absence of the recording paper 2 can be confirmed without the document tray 11 being removed. Even if the document tray is formed by a wire or the like instead of the transparent material, a similar effect can be obtained.

Also, this document tray 11 is detachably mounted on the facsimile apparatus 100, and as shown in FIG. 15, a mounting projection 301 is provided on the lower end of the document tray 11. This projection 301 is inserted into an insertion port provided in an outer cover (not shown), whereby the document tray 11 can be simply mounted on the facsimile apparatus 100.

Further, as described above, the document tray 11 can be simply mounted on the facsimile apparatus 100, whereby when the absence of the recording paper 2 is confirmed, it becomes possible to effect the loading of the recording paper 2 easily.

Now, as shown in FIGS. 15 and 16, a buckle preventing portion 300*a* which is a suppressing portion for suppressing the documents 12 stacked on the document stacking surface from being buckled is provided in opposed relationship with the document stacking surface, and a buckle preventing portion 300*b* which is a suppressing portion for preventing the documents 12 from being buckled is provided on the slider 30 in opposed relationship with the document stacking surface. The documents 12 are prevented by these buckle preventing portions 300*a* and 300*b* from being buckled, whereby the stacking performance for the documents can be maintained.

Also, in the present embodiment, the upper end portion 11*a* of the document stacking surface (document supporting portion 11B) is designed such that the position of the upper end 12*a*1 of the lowermost one of the stacked documents 12 can secure a sufficient distance L so as not to interfere with the recording paper 2 stacked up to a maximum number of stackable sheets, whereby the documents 12 and the recording paper 2 can be stably separated and fed.

The upper end portion 11*a* itself of the document stacking surface is also designed to be capable of securing a sufficient distance L1 so as not to interfere with the recording paper 2 stacked on the recording paper supply tray 8 up to the maximum number of stackable sheets, whereby the documents 12 and the recording paper 2 can be stably separated and fed.

As described above, the upper end 11*a* (of the document stacking surface) of the document tray 11 disposed above the recording paper supply tray 8, or the documents 12 stacked on the document tray 11 are positioned so as not to interfere with the recording paper 2 stacked on the recording paper supply tray 8, and also the document stacking surface of the document tray 11 is formed so that the angle formed with respect to the vertical direction by the document stacking surface may be greater on the upper end portion side than on the lower end portion side, whereby the recording paper 2 and the documents 12 can be reliably separated and fed.

As described above, as in the present embodiment, the auxiliary platen member 3*a* constituting the supporting portion for supporting the recording paper 2 is retractably provided in the common transport path 49, and when the image of the document is to be read, (the CS 22 held by) the CS holder 26 is moved to a position in which a document transport path is formed in the common transport path and the reading of the image of the document is possible while the auxiliary platen member 3*a* is retracted from the common transport path, whereby the downsizing and the recording and reading accuracy of the apparatus are maintained, and yet the contamination of the image reading portion 28 by the ink can be prevented.

Also, as already described, the separated recording paper 2 and document 12 are transported by the common transporting roller 10 and delivery roller 17, whereby there is not the necessity of discretely providing a reading drive motor and a document transporting mechanism and thus, a reduction in cost is realized and the downsizing of the entire apparatus can be achieved.

Further, even when there is adopted the image recording portion 1A of a construction using the ink jet recording process advantageous in such points as downsizing and running cost, the CS 22 is designed to be retracted from the common transport path 49 during the image recording operation as in the present embodiment, whereby the contamination by ink mist and ink leakage during the recording operation can be prevented and also, limitations in layout become less and the degree of freedom during design can be increased.

Furthermore, during the image recording operation, the CS 22 is adapted to be retracted from the common transport path 49, whereby even if the jam or the like of the recording paper occurs in the image recording portion 1A, it is possible to prevent the occurrence of the trouble that unfixed ink adheres to the reading surface of the CS 22 or the white reference member 25. Also, by covering the reading surface of the CS 22 with the white reference member 25, it is possible to greatly mitigate the contamination of the reading surface of the CS 22 by ink mist.

Also, when the document 12 is to be fed, the recording paper separating roller 19 is stopped at a position in which the cut-away portion 19A faces the document lower guide member 23, that is, does not come into between the document upper guide 14 and the document lower guide member 23, whereby even if for example, the document 12 is being fed, it becomes possible to suitably feed the recording paper 2.

Further, when the document 12 is to be fed, even if the document upper guide 14 provided above the document lower guide member 23 is pressed by the document 12 and is upwardly pivotally moved, this document upper guide 14 is made to abut against the shaft portion 19*c* of the recording paper separating roller 19 and is positioned so that the cut-away portion 19A of the recording paper separating roller 19 may not protrude into the document transport path R2, whereby the document 12 can be fed reliably and stably without contacting with the recording paper separating roller 19.

Further, as in the present embodiment, the driving force is made greater when the drive motor 20 is controlled by (the CPU 500*n* of) the control portion 500*a* to thereby drive the document separating roller 15 than when the recording paper separating roller 19 is driven, that is, the driving force is made greater when the document 12 is fed than when the recording paper 2 is fed, whereby even when the transport of the document and the transport of the recording paper between which there is a difference in necessary torque are effected by the use of the single drive motor 20, such inconveniences as noise and step-out can be prevented from occurring.

While in the present embodiment, description has been made of a case where the document tray 11 is disposed above the recording paper supply tray 8 and along therewith, the document separating roller 51 is provided upstream of the recording paper separating roller 19, the present invention is not restricted thereto, but the recording paper supply tray 8 may be disposed above the document tray 11 and along therewith, the recording paper separating roller 19 may be provided upstream of the document separating roller 51.

Further, while in the description hitherto made, description has been made of a case where the sheet feeding apparatus according to the present invention is provided in the facsimile apparatus, the present invention is not restricted thereto, but the sheet feeding apparatus may of course be provided for example, in a printer having an automatic paper feeding mechanism and a manual paper feeding mechanism. In such case, documents are not stacked on the second sheet stacking means as in the present embodiment, but recording paper in stacked on the second sheet stacking means.

What is claimed is:

1. A sheet feeding apparatus comprising:

first stacking means and second stacking means for stacking sheets thereon;

first sheet feeding means for feeding the sheets stacked on said first stacking means a first transport path for guiding the sheets fed from said first stacking means;

second sheet feeding means for feeding the sheets stacked on said second stacking means;

a second transport path for guiding the sheets fed from said second stacking means;

a common transport path, which said first transport path and said second transport path join;

reading means for reading images of documents transported in said common transport path;

moving means for moving said reading means between a first position away from said common transport path and a second position for reading the images of the documents transported in said common transport path;

a single drive source for generating a driving force for driving said first sheet feeding means, or said second sheet feeding means and said moving means; and controlling means for controlling said single drive, source so that the driving force generated by said single drive source when said single drive source drives said second sheet feeding means and said moving means is greater than the driving force generated by said single drive source when said single drive source drives said first sheet feeding means.

2. A sheet feeding apparatus according to claim 1, wherein said controlling means selectively changes over a magnitude of a driving cuffent for driving said single drive source so that the magnitude of the driving force may become different.

3. A sheet feeding apparatus according to claim 2, wherein said single drive source is a stepping motor of a constant current type, and said controlling means is provided with a driver for effecting a driving of said stepping motor, and a changing-over circuit for selectively changing over a magnitude of the driving cuffent.

4. A sheet feeding apparatus according to claim 1, further comprising:

a separating pawl for separating the sheets stacked on said first stacking means; and a separating piece abutting against said second sheet feeding means to separate the sheets stacked on said second stacking means.

5. A sheet feeding apparatus according to claim 4, further comprising a sheet transporting roller for receiving the sheets fed by said second sheet feeding means and transporting them to a downstream side, wherein said sheet transporting roller is driven by said single drive source.

6. An image reading and recording apparatus comprising:

first stacking means for stacking recording sheets thereon;

first sheet feeding means for feeding the recording sheets stacked on said first stacking means;

a first transport path for guiding the recording sheets fed from said first stacking means;

an image recording portion for recording images on the recording sheets fed by said first sheet feeding means;

second stacking means for stacking documents thereon;

second sheet feeding means for feeding the documents stacked on said second stacking means;

a second transport path for guiding the documents fed from said second stacking means;

a common transport path, which said first transport path and said second transport path join;

an image reading portion for reading the images of the documents fed by said second sheet feeding means;

moving means for moving said image reading portion between a first position away from said common transport path and a second position for reading the images of the documents transported in said common transport path;

a single drive source for generating a driving force for driving said first sheet feeding means, or said second sheet feeding means and said moving means; and controlling means for controlling said single drive so that the driving force generated by said single drive source when said single drive source drives said second sheet feeding means and said moving means is greater than the driving force generated by said single drive source when said single drive source drives said first sheet feeding means.

7. An image reading and recording apparatus according to claim 6, wherein said image recording portion is provided with the image recording means of an ink jet type adapted to be moved in a widthwise direction orthogonal to a sheet feeding direction while discharging ink, thereby recording images on the recording sheets, and said image reading portion are selectively movable to a reading position for reading the images of said documents and a position in which it does not hamper the movement of said image recording means.

8. An image reading and recording apparatus according to claim 7, wherein the movement of said image reading portion to said reading position is effected in operative association with a document transporting operation.

9. An image reading and recording apparatus according to claim 6, further comprising:

a separating pawl for separating the recording sheets stacked on said first stacking means; and a separating piece abutting against said second sheet feeding means to separate the documents stacked on said second stacking means.

10. An image reading and recording apparatus according to claim 9, further comprising a document transporting roller for receiving the documents fed by said second sheet feeding means, and transporting them to a downstream side, wherein said document transporting roller is driven by said single drive source.

* * * * *

UNITED STATES PATENT AND TRADEMARK OFFICE

CERTIFICATE OF CORRECTION

PATENT NO. : 7,290,763 B2
APPLICATION NO. : 10/739348
DATED : November 6, 2007
INVENTOR(S) : Suzuki et al.

It is certified that error appears in the above-identified patent and that said Letters Patent is hereby corrected as shown below:

COLUMN 7:
Line 14, "having" should read --has--.
Line 29, "lower cover 10A," should read --lower cover 100A,--.

COLUMN 8:
Line 13, "are" should read --is--.

COLUMN 12:
Line 59, "shaft portion. 19C" should read --shaft portion 19C--.

COLUMN 20:
Line 10, "drive," should read --drive--.

Signed and Sealed this

Seventeenth Day of June, 2008

JON W. DUDAS
*Director of the United States Patent and Trademark Office*